US011533998B2

(12) United States Patent
Kinoshita et al.

(10) Patent No.: US 11,533,998 B2
(45) Date of Patent: Dec. 27, 2022

(54) CHAIR

(71) Applicants: KOKUYO CO., LTD., Osaka (JP); TAKANO CO., LTD., Nagano (JP)

(72) Inventors: Yojiro Kinoshita, Osaka (JP); Katsuaki Hayashi, Osaka (JP); Takao Sugano, Osaka (JP); Kenta Asano, Osaka (JP); Takayoshi Kanou, Osaka (JP); Kenta Shiozawa, Ina (JP); Kensuke Nakamura, Ina (JP); Kazuki Tsukadaira, Ina (JP); Naoya Niimura, Ina (JP)

(73) Assignees: KOKUYO CO., LTD., Osaka (JP); TAKANO CO., LTD., Nagano (JP)

( * ) Notice: Subject to any disclaimer, the term of this patent is extended or adjusted under 35 U.S.C. 154(b) by 0 days.

(21) Appl. No.: 17/280,460

(22) PCT Filed: Oct. 19, 2018

(86) PCT No.: PCT/JP2018/039048

§ 371 (c)(1),
(2) Date: Mar. 26, 2021

(87) PCT Pub. No.: WO2020/079840

PCT Pub. Date: Apr. 23, 2020

(65) Prior Publication Data

US 2022/0031073 A1 Feb. 3, 2022

(51) Int. Cl.
*A47C 1/032* (2006.01)
*A47C 3/025* (2006.01)
(Continued)

(52) U.S. Cl.
CPC ..... *A47C 3/026* (2013.01); *A47C 1/03261* (2013.01); *A47C 1/03272* (2013.01);
(Continued)

(58) Field of Classification Search
CPC ..... A47C 3/0257; A47C 3/026; A47C 7/004; A47C 1/03261; A47C 1/03272; A47C 7/44
(Continued)

(56) References Cited

U.S. PATENT DOCUMENTS 4,575,151 A * 3/1986 Edstrom ..... A47C 7/445 297/302.6
5,951,109 A * 9/1999 Roslund, Jr ..... A47C 1/03255 297/299 X
(Continued)

FOREIGN PATENT DOCUMENTS

EP 3643205 A1 4/2020
JP 2018-507757 A 3/2018
(Continued)

OTHER PUBLICATIONS

International Search Report dated Jan. 22, 2019, issued in counterpart International Application No. PCT/JP2018/039048(1 page).
(Continued)

*Primary Examiner* — Rodney B White
(74) *Attorney, Agent, or Firm* — WHDA, LLP

(57) ABSTRACT

A chair includes a leg 1, a seat 5 including a pressure receiving surface PS, a backrest 6, and a support mechanism SM. The seat 5 can move in the front-rear or left-right direction along a predetermined trajectory and to downwardly incline a tip side of the seat 5 in a movement direction in accordance with a movement of the seat 5 from a predetermined reference position (S). The support mechanism SM includes a return-force generation unit configured to generate, in accordance with an amount of movement, a return force in a direction in which the seat 5 moved from the reference position (S) in the front-rear or left-right direction is returned to the reference position (S), and movably supports the backrest 6 in the left-right direction
(Continued)

together with a movement of the seat 5 in the left-right direction.

15 Claims, 27 Drawing Sheets

(51) Int. Cl.
*A47C 3/026* (2006.01)
*A47C 7/44* (2006.01)
*A47C 7/00* (2006.01)

(52) U.S. Cl.
CPC ..... *A47C 3/0257* (2013.01); *A47C 7/004* (2013.01); *A47C 7/44* (2013.01)

(58) Field of Classification Search
USPC ..... 297/285–299, 314
See application file for complete search history.

(56) References Cited

U.S. PATENT DOCUMENTS 7,100,983 B1 * 9/2006 Gant ..... A47C 3/025 297/314 X
7,434,879 B2 * 10/2008 Ueda ..... F16F 1/22 297/296 X
7,665,805 B2 * 2/2010 Ueda ..... A47C 1/03261 297/307
7,712,833 B2 * 5/2010 Ueda ..... A47C 7/445 297/296 X
7,717,513 B2 * 5/2010 Ueda ..... A47C 7/444 297/300.2
7,862,120 B2 * 1/2011 Ueda ..... A47C 31/023 297/285
8,029,060 B2 * 10/2011 Parker ..... A47C 7/004 297/314 X
9,826,836 B2 * 11/2017 Sander ..... A47C 7/445
10,058,180 B2 * 8/2018 Desanta ..... A47C 1/03255
10,537,181 B2 * 1/2020 Brodbeck ..... A47C 7/40
10,667,612 B2 * 6/2020 Matlin ..... A47C 7/14
10,820,704 B2 * 11/2020 Sugano ..... A47C 7/02
10,842,275 B2 * 11/2020 Kinoshita ..... A47C 7/14
10,842,276 B2 * 11/2020 Sugano ..... A47C 7/004
10,856,660 B2 * 12/2020 Kinoshita ..... A47C 3/0255
10,945,529 B2 * 3/2021 O'Boyle ..... A47C 7/4454
11,096,495 B2 * 8/2021 Yajima ..... A47C 7/14
11,229,291 B1 * 1/2022 Collier ..... A47C 7/029
11,253,077 B2 * 2/2022 Yajima ..... A47C 1/024
2009/0261641 A1 * 10/2009 Dickie ..... A47C 9/002 297/314
2016/0081483 A1 * 3/2016 Harrison ..... A47C 7/448 297/217.2
2018/0153306 A1 6/2018 Schmitz et al.
2019/0045928 A1 * 2/2019 Yajima ..... A47C 7/004
2019/0343286 A1 * 11/2019 Sugano ..... A47C 1/03294
2020/0085195 A1 * 3/2020 Shibamoto ..... A47C 7/40
2020/0205573 A1 * 7/2020 Yajima ..... A47C 3/026
2020/0315352 A1 10/2020 Sugano et al.
2020/0315355 A1 * 10/2020 Shibamoto ..... A47C 3/40

FOREIGN PATENT DOCUMENTS

WO 2016/023128 A1 2/2016
WO 2017/145271 A1 8/2017
WO 2017/221312 A1 12/2017
WO 2018/117097 A1 6/2018

OTHER PUBLICATIONS

Extended (Supplementary) European Search Report dated Apr. 26, 2022, issued in counterpart EP Application No. 18937379.8. (7 pages).
Office Action dated Oct. 4, 2022, issued in corresponding Japanese Patent Application No. JP2020-551701, with English machine translation (5 pages).
Office Action dated Oct. 13, 2022, issued in counterpart CA application No. 3,113,842. (5 pages).

* cited by examiner

CHAIR

TECHNICAL FIELD

The present invention relates to a chair suitably applicable as an office revolving chair and the like.

BACKGROUND ART

Conventionally, it has been proposed a large number of chairs, especially office revolving chairs, with an aim for a seated person to maintain a comfortable sitting posture for a long time in an office, at home or the like.

Among these office revolving chairs, it has been provided a chair to provide suitable support corresponding to a body movement of a seated person, with an aim to provide a stability in use even in a subsequent posture after a posture of the seated person is changed to move a center of gravity (Patent Document 1).

The chair includes a leg erected on a floor surface, a seat arranged above the leg, and a support mechanism interposed between the leg and the seat, in which the support mechanism is arranged below the seat, is configured to movably support the seat at least at two locations in a front-rear direction and two locations in a left-right direction along a predetermined trajectory, includes a seat inclining function of downwardly inclining a tip side of the seat in a movement direction of the seat as the seat moves from a predetermined reference position, and further includes a return-force generation mechanism for generating, in accordance with an amount of movement, a return force in a direction in which the seat moved from the reference position in the front-rear or left-right direction is returned to the reference position.

According to such a chair, it is possible to exhibit an effect in which the seated person can perceive a comfortable sitting feeling even if sitting for a long time, and can stably obtain a high work efficiency.

PRIOR ART DOCUMENT

Patent Document

Patent Document 1: WO2017/145271

SUMMARY OF THE INVENTION

Technical Problem

As described above, in a configuration in which a seat swings in the front-rear or left-right direction while being supported by a support mechanism, a tip side of the seat in the movement direction inclines downward, and the moved seat is returned to a reference position by a return-force generation mechanism, a seated person may desire to utilize a swinging function in the left-right direction in a wide movable range. However, the movable range is limited and when the seated person utilizes the chair in a range close to the limit of the movable range, the seated person needs to forcibly move the upper body of the seated person against the return-force generation mechanism to gain momentum and thereby tilt the seat or the back.

Under such circumstances, the seated person is forced to take an unnatural posture or perform an uncomfortable operation, and thus, it is not possible to realize an appropriate support state for the seated person.

To allow for a wide swinging operation, it is necessary to expand the movable range through the support mechanism, but in this case, the structure of the support mechanism is large, which has a negative effect on the appearance. Further, assuming that the design is changed to expand the movable range, the relationship between the displacement amount and the return force in the return-force generation mechanism also changes, and thus, compared to the design before the change, the return force is small when the displacement amount is small, and conversely, the return force is excessively large when the displacement amount is large, which makes the adjustment difficult. Moreover, the movable range changes depending on how the seated person uses the seat, and thus, it is not appropriate to uniformly increase the movable range of the support mechanism.

In view of this situation, it is desirable to allow for a swinging movement for complementing an original swinging function in an overlapping manner, without changing the original swinging function.

That is, it is considered appropriate to add an element allowing for a wide swinging operation without affecting the basic return force.

From this point of view, an object of the present invention is to provide a chair in which a further new function of complementing a swinging movement is added to a chair including a new function of swinging in the front-rear or left-right direction as described above.

Solution to Problem

The present invention adopts the following means to achieve such object.

That is, a configuration is assumed in which a chair according to the present invention includes a leg erected on a floor surface, a seat being arranged above the leg and including a pressure receiving surface, and a support mechanism arranged below the seat to be interposed between the leg and the seat and configured to movably support the seat in a front-rear or left-right direction along a predetermined trajectory and to downwardly incline a tip side of the seat in a movement direction in accordance with a movement of the seat from a predetermined reference position, and the support mechanism includes a return-force generation unit configured to generate, in accordance with an amount of movement, a return force in a direction in which the seat moved from the reference position in the front-rear or left-right direction is returned to the reference position.

The chair is characterized in that the seat includes a main body unit and an amplification element attached to the main body unit and configured to further amplify a movement operation of the main body unit in the left-right direction among movement operations of the main body unit.

It is noted that, in the present specification, "moving in the front-rear or left-right direction" is not limited to an aspect of moving in the front-rear direction or an aspect of moving in the left-right direction, but also includes an aspect of moving simultaneously in the front-rear direction and the left-right direction, that is, an aspect of moving in an oblique direction.

Thus, it is possible to allow for a movement operation of the seat in a wider range in the left-right direction beyond a support range by the support mechanism, without changing a function of the support mechanism. Therefore, a movable range of a seated person using the seat increases in the left-right direction, and thus, it is possible to provide a chair in which a seated person hardly feels exhaustion even if seated for a long time, and also providing a better refreshing effect.

Moreover, a configuration may be adopted in which an amplification operation by the amplification element occurs during an original movement operation of the support mechanism, and thus, it is also easy to ensure an amount of movement without increasing the reaction force.

Alternatively, it is assumed that a chair according to the present invention includes a leg erected on a floor surface, a seat arranged above the leg, a backrest being arranged behind the leg and including a pressure receiving surface, and a support mechanism arranged below the seat to be interposed between the leg and the seat and configured to movably support the seat in the front-rear or left-right direction along a predetermined trajectory and to downwardly incline a tip side of the seat in a movement direction in accordance with a movement of the seat from a predetermined reference position, and the support mechanism includes a return-force generation unit configured to generate, in accordance with an amount of movement, a return force in a direction in which the seat moved from the reference position in the front-rear or left-right direction is returned to the reference position, and is configured to movably support the backrest in the left-right direction together with a movement of the seat in the left-right direction.

The chair is characterized in that the backrest includes a main body unit and an amplification element attached to the main body unit and configured to further amplify a movement operation of the main body unit in the left-right direction among movement operations of the main body unit.

Even with these configurations, a similar operation and effect to the case of the seat can be obtained.

In these configurations, it is desirable that the amplification element is configured to perform an amplification operation independent from a movement operation of the main body unit in the left-right direction. If the movement operation is independent, it is possible to choose an amplification amount and an amplification direction independently from an amount of movement of the main body unit in the left-right direction, and to increase the degree of freedom of the amplification.

In this case, it is desirable that the amplification element is configured to perform an amplification operation including a directional component other than a movement operation of the main body unit in the left-right direction. Thus, a more appropriate support state for the movement of the seated person can be realized, compared with a case where the amplification is monotonous.

A specific example includes a configuration in which the movement operation of the main body unit in the left-right direction is a swinging operation in the left-right direction in a front view, and the amplification element is configured to perform an amplification operation including a turning operation in the left-right direction in a plan view. Thus, it is easy to respond to an original rolling operation and a twisting operation of the seated person.

Further, it is desirable that the amplification element is an amplification element configured to perform either an amplification operation in a positive direction for increasing a movement operation in the left-right direction or an amplification operation in a negative direction for reducing the movement operation, or is an amplification element configured to perform both an amplification operation in a positive direction for increasing a movement operation in the left-right direction and an amplification operation in a negative direction for reducing the movement operation. In some cases, a seated person may desire to restrict the movement of the chair, and the configuration described above is effective in such a case. It is noted that, in the present specification, a "negative amplification" refers to a slowing operation in which the movement operation is reduced.

Alternatively, it is also desirable that the amplification element is a mechanically movable unit attached via a bearing unit. If the mechanically movable unit is provided, an amplification in a direction along a predetermined movement can be obtained.

Alternatively, it is also desirable that the amplification element is a rotation unit attached to the main body unit to be rotatable around a shaft center extending in a direction orthogonal to the left-right direction. If the rotation unit is provided, it is possible to specifically set a rotation radius and the like.

Alternatively, it is also desirable that the amplification element is a universal operation unit attached to the main body unit to be pivotable in the front-rear direction including the left-right direction, or the left-right direction. If the universal operation unit is provided, it is possible to allow for a movement in a direction other than the left-right direction in the amplification operation.

Alternatively, it is also desirable that the amplification element includes flexibly deformable horizontal strap bodies arranged along the left-right direction. This is an effective configuration if the amplification operation for the movement of the main body unit is performed as an independent operation different from a swinging movement in the left-right direction.

In this case, it is desirable that the horizontal strap bodies are engaged with a plurality of flexibly deformable vertical strap bodies arranged along the vertical strap body arranged at a center portion in the left-right direction and a position displaced from the center portion in the left-right direction. Such a configuration is one aspect of a preferred implementation, and thus, a mesh fabric in which vertical strap bodies and horizontal strap bodies are previously woven can be adopted.

In these cases, it is desirable that a vertical strap bodies and the horizontal strap bodies are arranged in an opening of a frame body included in the main body unit. With this configuration, the amplification operation of the strap bodies can be appropriately performed by utilizing the thickness of the frame body.

In this case, it is desirable that a side support protruding toward a seated person is provided in left and right side units of the frame body. When the seated person strongly rocks the seat or the backrest, it is possible to appropriately support the seated person so that the seated person does not lose weight balance.

In view of the above, it is desirable that the main body unit includes a frame body having a left-right pair of side frame units extending in parallel, the side frame units include intermediate protrusions protruding furthermost toward a seated person at a position other than both ends of the side frame units in an extending direction of the side frame units, and an upholstery material having flexibility with low stretchability is spanned at least between the intermediate protrusions of the left and right side frame units to form the amplification element. Therefore, the upholstery material spanned between the intermediate protrusions preferentially abuts against the seated person, so that a load of the seated person is easily received locally and a deformation from the received load increases the tension around the seated person, and thus, an effect of amplifying a movement in the left-right direction is intensified. For this reason, the seated person can perceive a feeling of being inclined more than the inclination of the backrest or the seat. The intermediate protrusions serve as side supports supporting the body of the inclined seated person from the side via the upholstery material, and thus, it is possible to effectively prevent the seated person from losing balance.

Alternatively, it is desirable that the amplification element includes a first amplification element configured to amplify a movement operation of the main body unit in the left-right direction and a second amplification element configured to further amplify an operation of the first amplification element. Thus, it is possible to provide an amplification function, with a high degree of freedom, of widening the original swinging movement in the left-right direction.

One aspect of a specific implementation includes a configuration in which the first amplification element is a rotation unit attached to the main body unit to be rotatable around a shaft center extending in a direction orthogonal to the left-right direction, and the second amplification element includes flexibly deformable horizontal strap bodies arranged along the left-right direction.

Alternatively, another aspect of a specific implementation includes a configuration in which the first amplification element is a universal operation unit attached to the main body unit to be rotatable in the front-rear direction including the left-right direction, or the left-right direction, and the second amplification element includes flexibly deformable horizontal strap bodies arranged along the left-right direction.

In the aspects described above, it is desirable that the amplification element includes an auxiliary return-force generation unit configured to return, if a pressure applied to the pressure receiving surface is removed, from an amplification destination to a reference position. Thus, the amplification element can always be reset to an initial position.

Advantageous Effect of the Invention

The present invention is configured as described above, and thus, it is possible to provide a new, useful chair capable of allowing for a swinging movement complementing an original swinging function in an overlapping manner, without changing the original swinging function, and as a result, allowing for a wide swinging operation, without affecting a basic return force.

DESCRIPTION OF THE EMBODIMENT

First Embodiment

Figure 1:
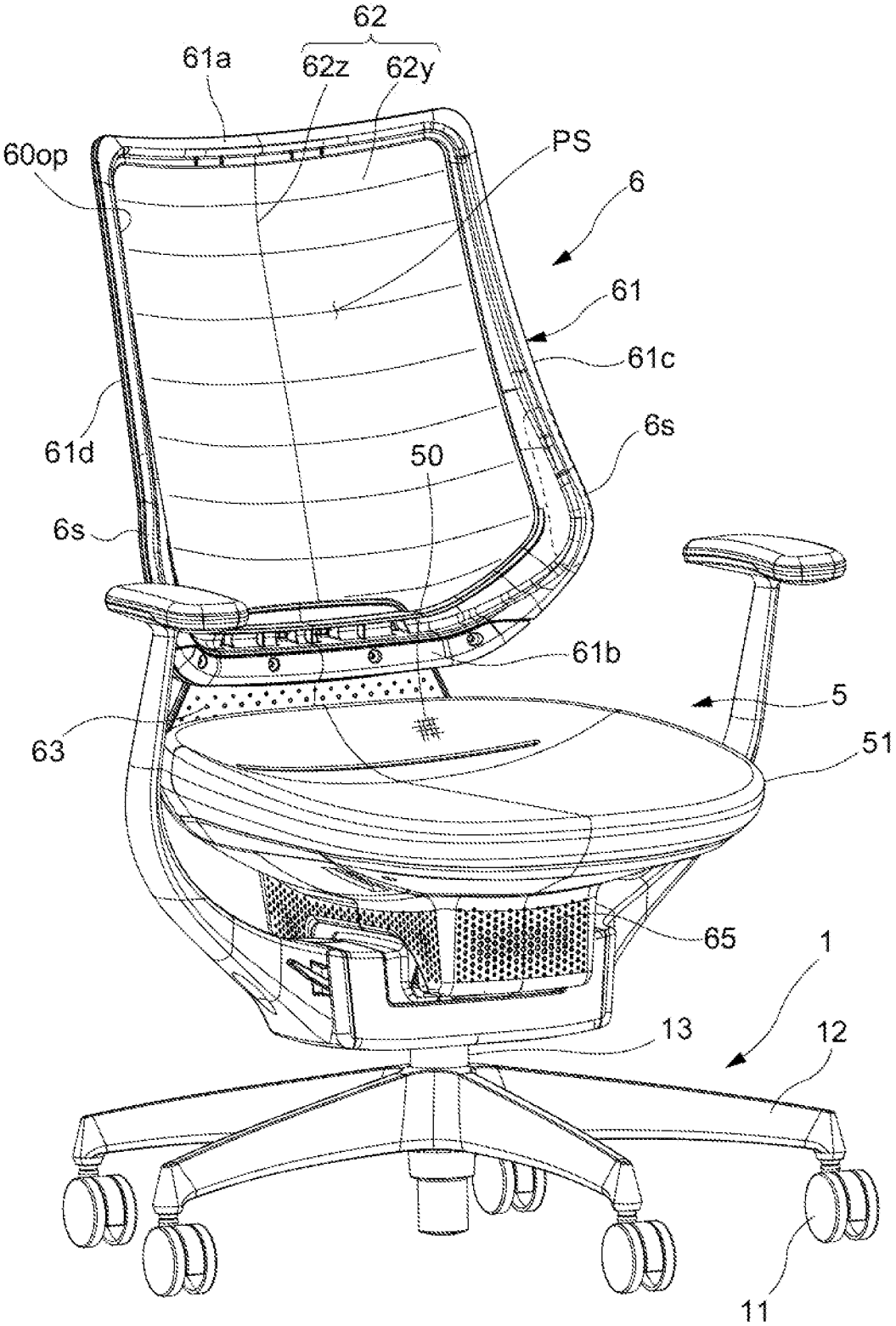
FIG. 1 is a front perspective view of a chair according to FIRST EMBODIMENT of the present invention.

A first embodiment of the present invention will be described below with reference to FIG. 1 to FIG. 14.

A chair according to the embodiment is referred to as an office revolving chair suitably usable in an office or at home.

As illustrated in FIGS. 1 to 5, the chair mainly includes a leg 1 erected on a floor surface, a support base unit 2 arranged above the leg 1, a support mechanism SM being attached to the support base unit 2 and including a front-rear support unit 3 and a left-right support unit 4, and a backrest 6 and a seat 5 supported via the support mechanism SM.

The leg 1 includes a leg vane 12 formed radially in a plan view, a caster 11 being attached on a bottom side of the leg vane 12 and rollably contacting the floor surface, and a leg supporting post 13 erected from a center of the leg vane 12. The support base unit 2 is rotatably attached to an upper end side of the leg supporting post 13.

The support base unit 2 functions as a structured body for receiving a load of a seated person, includes, as a main body, a support base main body 21 including a through hole 21*a* into which an upper end of a supporting post 13 is inserted and which runs in an up-down direction, and on both left and right sides of the support base main body 21, a left-right pair of elbow mounting units 23 are integrally formed with the support base main body 21 via a bearing base unit 22. A shaft swing damper 21*b* is mounted in a hole 21*a* opening on a surface of the support base main body 21 in the front-rear direction.

Figure 6:
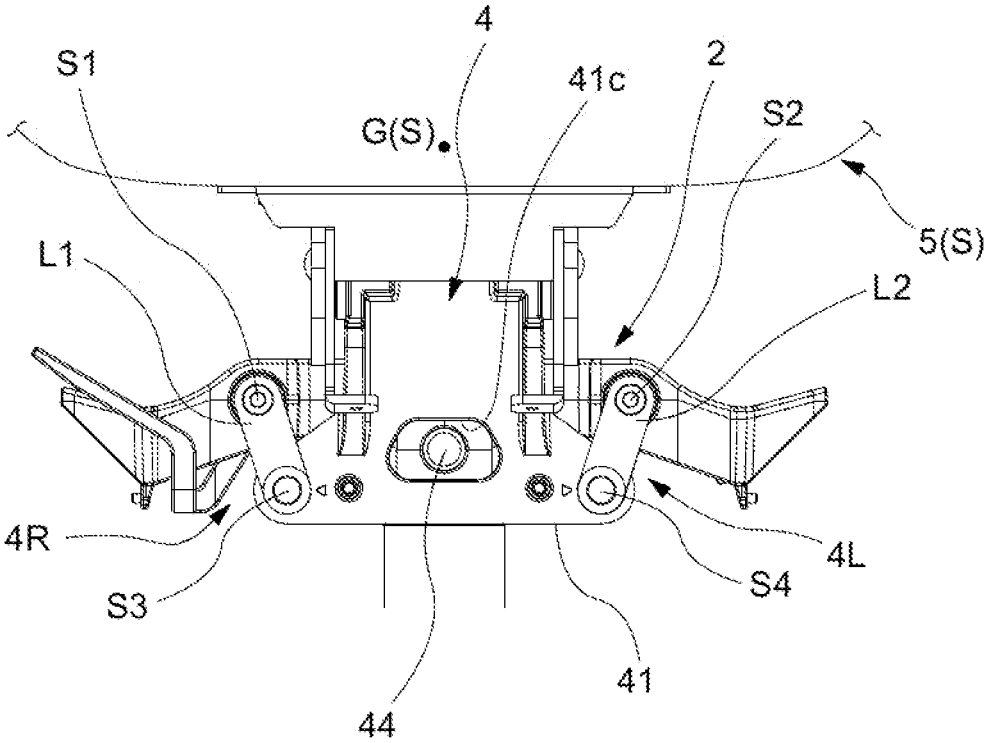
FIG. 6 is an explanatory diagram of a left-right support unit in the same embodiment.
Figure 8:
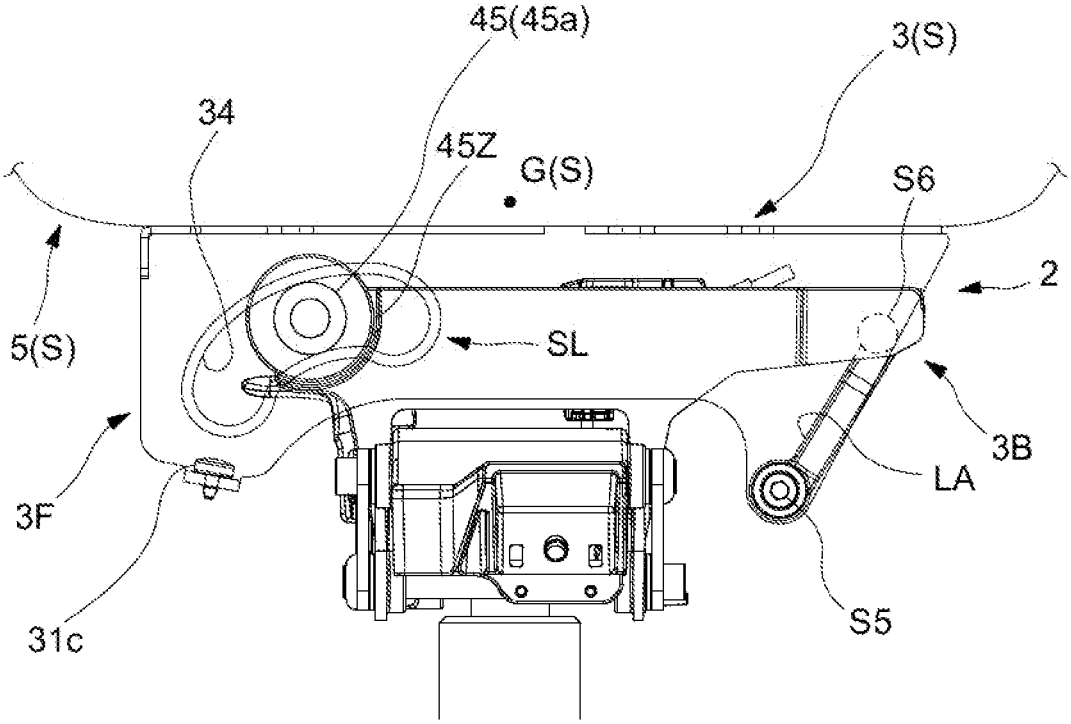
FIG. 8 is an explanatory diagram of a front-rear support unit in the same embodiment.

The support mechanism SM is interposed between the leg 1 and the seat 5, and in the support mechanism SM, the front-rear support unit 3 and the left-right support unit 4 are arranged below the seat 5, and the support mechanism SM alone supports the seat 5 movably in the front-rear or left-right direction. As illustrated in FIG. 8, the front-rear support unit 3 includes a front support unit 3F and a rear support unit 3B to directly or indirectly support the seat 5 at least at two locations in the front-rear direction. As illustrated in FIG. 6, the left-right support unit 4 includes a left support unit 4L and a right support unit 4R to directly or indirectly support the seat 5 at two locations in the left-right direction. The support mechanism SM combines the front-rear support unit 3 and the left-right support unit 4 to move the seat 5 in the front-rear or left-right direction. At that time, the support mechanism SM is configured to draw, as a trajectory for supporting a supporting location of the seat 5, a trajectory along which a tip side of the seat 5 in the movement direction is inclined downward according to a movement of the seat 5 from a reference position (S). The support mechanism SM further includes a later-described return-force generation unit configured to generate, in accordance with an amount of movement, a return force in a direction in which the seat 5 moved from the reference position (S) in the front-rear or left-right direction is returned to the reference position (S). Configurations of the left-right support unit 4 and the front-rear support unit 3 included in the support mechanism SM will be specifically described below.

Figure 5:
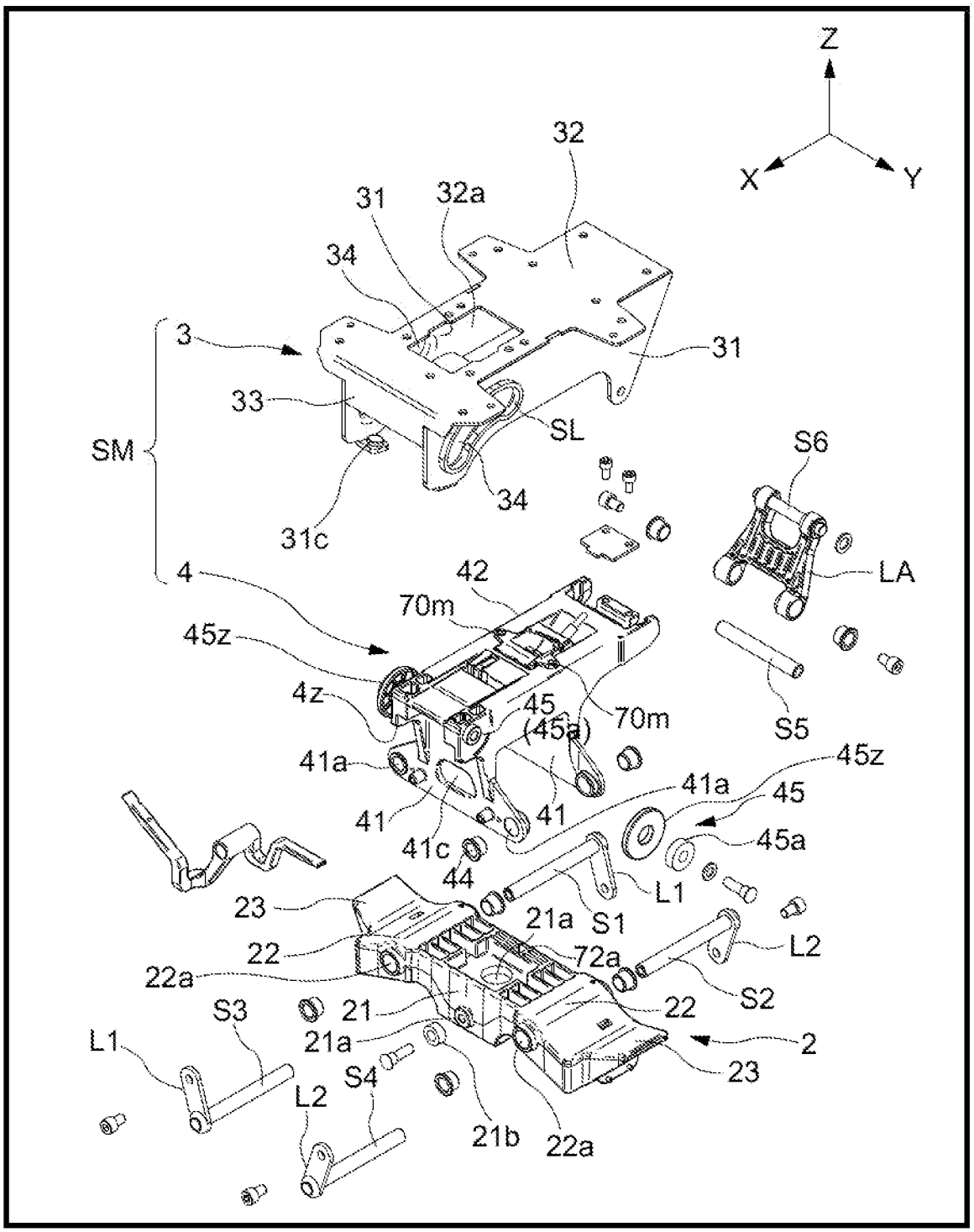
FIG. 5 is a further exploded perspective view of FIG. 3.
Figure 7:
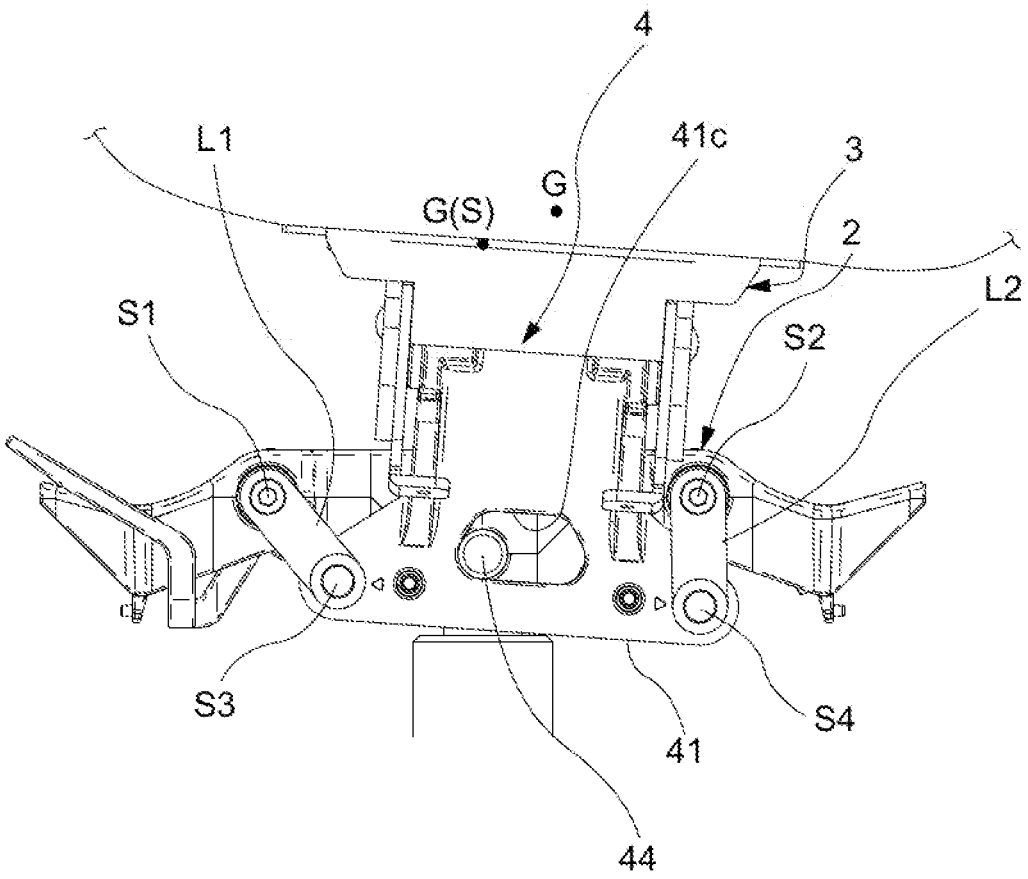
FIG. 7 is an explanatory diagram of a left-right support unit in the same embodiment.

As illustrated in FIGS. 5 to 7, in the left-right support unit 4, to perform a swinging operation in the left-right direction with respect to the support base unit 2, upper ends of left-right swing links L1 and L2 are mounted in holes 22*a* opening on front and rear surfaces of the bearing base unit 22, via swing shafts S1 and S2, and the left-right support unit 4 is suspended from and supported by lower ends of these links L1 and L2. Thus, a front-rear support unit 4 includes a pair of plate-shaped link bases 41 and 41 arranged to be separated from each other in the front-rear direction, and a left-right swing main body 42 configured to connect the pair of link bases 41 and 41. At both left and right ends of the link base 41, holes 41*a* and 41*a* are opened, and lower ends of the left-right swing links L1 and L2 are attached via swing shafts S3 and S4. FIGS. 6 and 7 illustrate a state where the links L1 and L2 are attached via the swing shafts S1 to S4. That is, the left-right swing main body 42 is arranged in a suspended state to be swingable to the left and right with respect to the support base unit 2 via the left-right swing links L1 and L2, and the left-right swing links L1 and L2 are attached so that the distance between the lower ends is smaller than the distance between the upper ends.

That is, as illustrated in FIGS. 6 and 7, when the left-right support unit 4 swings, the link L2 (L1) located at the swing destination approaches a vertical posture and the other link L1 (L2) approaches a horizontal posture, as a result of which an operation is performed in which a center of gravity G of the seat 5 including the left-right support unit 4 is lifted from a reference position G (5) while tilting so that a tip side of the seat 5 in the movement direction is lower. That is, the left support unit 4L and the right support unit 4R form a return-force generation unit for returning the seat 5 to the reference position (S).

A window 41*c* is opened at the center of the link base 41, a rolling damper 44 is positioned in the window 41*c*, and a swing range of the left-right support unit 4 is restricted to a range where the rolling damper 44 can perform a relative movement within the window 41*c*.

Figure 9:
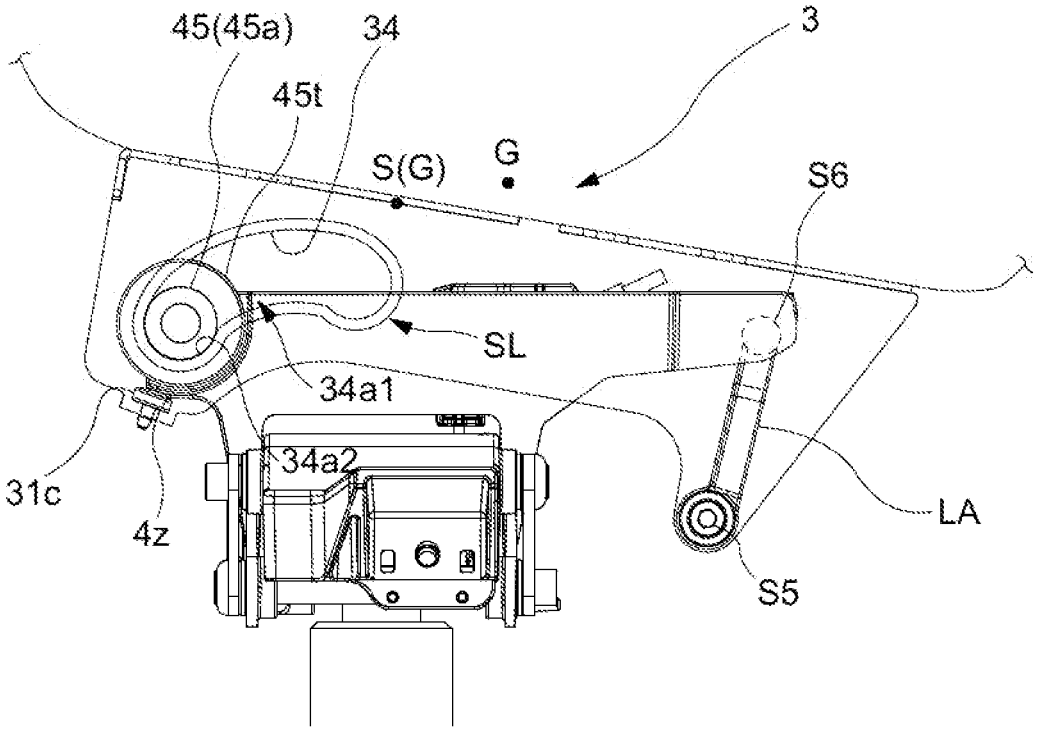
FIG. 9 is an explanatory diagram of a front-rear support runt in the same embodiment.

As illustrated in FIGS. 5, 8, and 9, to perform a swinging operation in the front-rear direction with respect to the left-right support unit 4, the front-rear support unit 3 includes a pair of plate-shaped rail plates 31 and 31 arranged to be separated from each other in the left-right direction, and an upper connection plate 32 and a front connection plate 33 configured to connect the pair of rail plates 31 and 31. At a front side of the rail plates 31, a guide hole 34 is provided to penetrate the rail plates 31, a bearing (follower) 45*a* is engaged with the guide hole 34, and the bearing 45*a* being a rolling body 45 that allows for an independent left and right rolling movement and is provided on side surfaces at a front end side of the left-right swing main body 42. The reference sign 45*z* in the drawings indicates a spacer being arranged on an inner surface side of the rail plate 31 and having a diameter larger than that of the bearing 45*a*. The rear end side of the rail plate 31 extends downward, a lower end of a link arm LA, being a swingable front-rear swing link, is attached via a swing shaft S5 to an extension end of the rail plate 31, and the upper end of the link arm LA is supported by the rear end of the left-right support unit 4 via a swing shaft S6. That is, the rear end of the front-rear support unit 3 is arranged in a suspended state to be swingable forward and rearward with respect to the left-right support unit 4 via the link arm LA. The guide hole 34 has a shape that is gently curved forward and downward from the rear end side toward the front end side, and at the rear end, there is provided a shockless unit SL configured to mitigate a shock when the front-rear support unit 3 moves forward together with the seat 5. Axles of the bearing 45*a* being the rolling body 45 in the example of the drawings are separated to the left and right. However, as long as the bearing 45*a* being the rolling body 45 is rollable independently at the right and left, the axle may be common.

Figure 10:
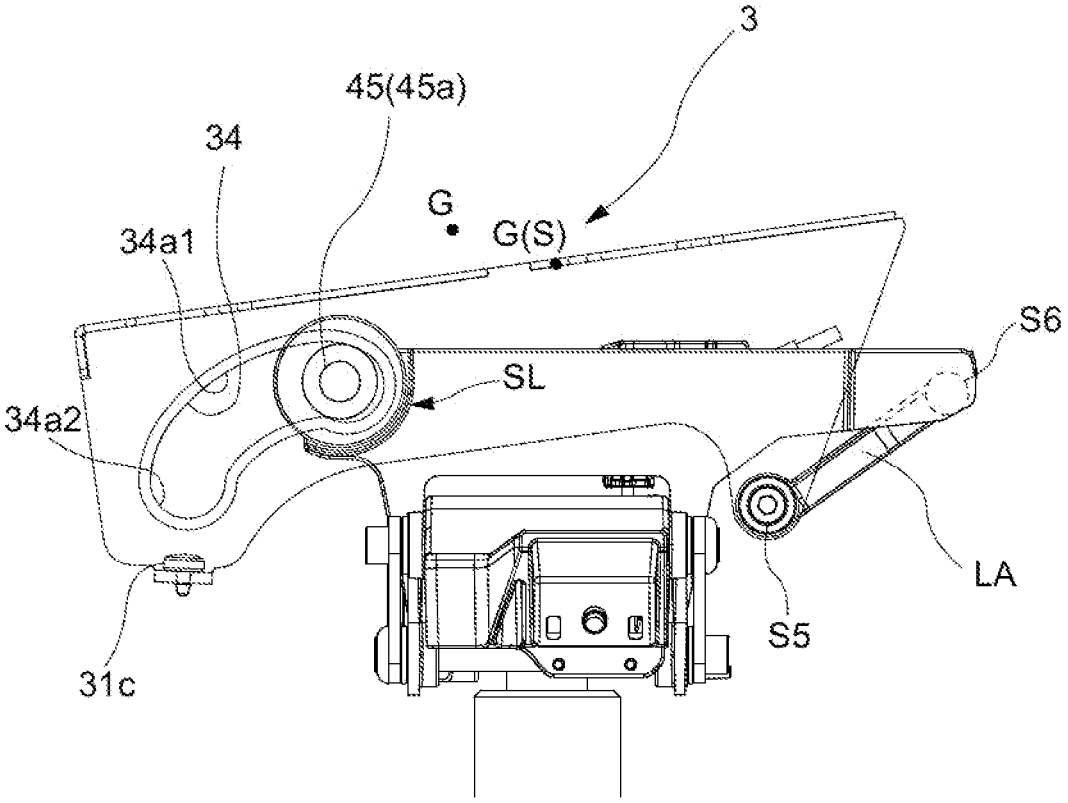
FIG. 10 is an explanatory diagram of a front-rear support unit in the same embodiment.

That is, if the front-rear support unit 3 moves rearward, as illustrated in FIG. 9, from the state of FIG. 8 where the upper surface of the front-rear support unit 3 takes a substantially horizontal posture, the bearing 45*a* performs a relative movement with respect to the front end side of the guide hole 34 at the front end of the front-rear support unit 3, so that the front end side of the front-rear support unit 3 is lifted to a high position, and the link arm LA approaches a vertical posture. As a result, an operation is performed where the rear end side of the front-rear support unit 3 is guided to a lower position. Conversely, if the front-rear support unit 3 moves forward, as illustrated in FIG. 10, from the state of FIG. 8, the bearing 45*s* performs a relative movement with respect to the rear end side of the guide hole 34 at the front end of the front-rear support unit 3, so that the front end side of the front-rear support unit 3 is guided to a lower position, and the link arm LA approaches a horizontal posture. As a result, an operation is performed where the rear end of the front-rear support unit 3 is lifted to a higher position. That is, the front-rear support unit 3 performs an inclining operation so that a tip side of the front-rear support unit 3 in the movement direction is also lowered in the front-rear direction. The front support unit 3F and the rear support unit 3B configure a return-force generation unit for returning the seat 5 to the reference position (S).

During this time, the seat 5 performs an operation in which the seat 5 is tilted so that the tip side of the seat 5 in the movement direction is lowered, and the center of gravity G of the seat 5 including the front-rear support unit 4 is lifted from the reference position G (S).

On the front end side of the rail plate 31 included in the front-rear support unit 3, a pitching damper 31*c* formed by bending a part of the rail plate 31 is provided, and if the front-rear support unit 3 swinging rearward, the pitching damper 31*c* abuts against a front end lower part 4*z* (see FIG. 3) of the left-right support unit 4 in the vicinity of the swing end to mitigate the shock at the rearward movement end.

Figure 3:
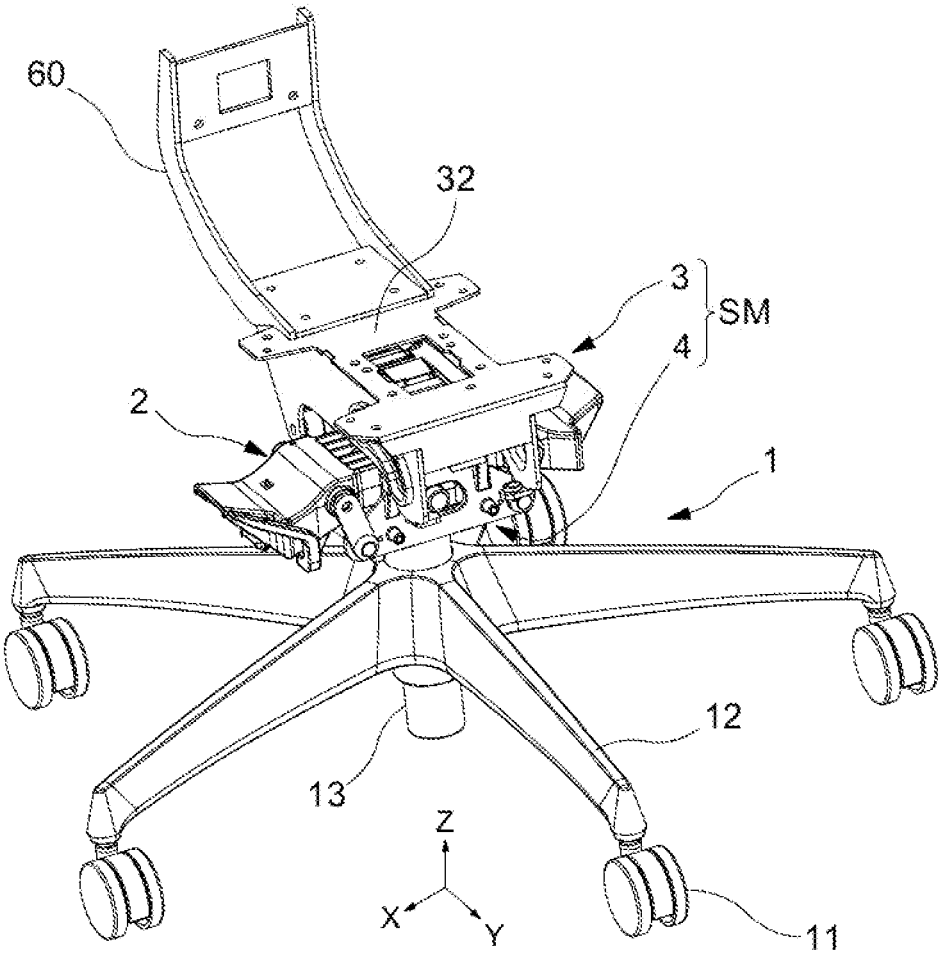
FIG. 3 is an exploded perspective view of FIG. 1

As illustrated in FIG. 3, a back frame 60 included in the backrest 6 is attached to a rear part of the upper connection plate 32 included in the front-rear support unit 3, and the seat 5 is attached to the upper connection plate 32 from above the place where the back frame 60 is attached to the rear part of the upper connection plate 32. That is, the back frame 60 supporting a backrest 62 is erected integrally behind the seat 5 and when the seat 5 swings in the front rear or left-right direction with respect to the support base unit 2, as indicated by X and Y in the drawing, the back frame 60 also moves together with the seat 5.

In the present embodiment, in the shape of the guide hole 34 illustrated in FIG. 9, a first region 34*a*1 is designated by a constant operation range including the reference position (S), and a second region 34*a*2 is designated by a range reaching a vicinity of an operation end at a rear inclined side beyond the operation range. In the first region 34*a*1, the seat 5 is guided in a direction away from the reference position (S), via the follower 45*a* and in a movement coordinated with the follower 45*a*, while the movement of the center of gravity in the height direction of the seat 5 is suppressed to a small extent (that is, the return force to the reference position (S) is suppressed to a small extent) and the inclination angle of the seat 5 is suppressed to a small extent. In reaching the second region 34*a*2, the seat 5 is guided in a direction away from the reference position (S), via the follower 45*a* and in a movement coordinated with the followers 45*a*, while the movement of the center of gravity in the height direction of the seat 5 is increased (that is, the return force to the reference position is increased) and the inclination angle of the seat 5 is increased. That is, in the present embodiment, a slowing unit is configured so that an easiness of movement of the seat 5 is gradually reduced by an increase in return force as the follower 45*a* is driven from the first region 34*a*1 to the second region 34*a*2 so that the seated person does not feel discomfort due to a sudden rear inclination operation of the seat 5. In other words, the slowing unit includes the first region 34*a*1 and the second region 34*a*2. The first region 34*a*1 and the second region 34*a*2 are continuous, and thus, it is difficult to clearly indicate a boundary position. However, a position at which a movement rate of the center of gravity in the height direction of the seat 5 changes from low to high may be considered as the boundary position.

As described above, in a chair having a configuration in which the seat 5 and the backrest 6 move to swing in the front-rear or left-right direction, in the present embodiment, the backrest 6 incorporates an amplification element configured to amplify a swinging movement in the left-right direction.

Figure 12:
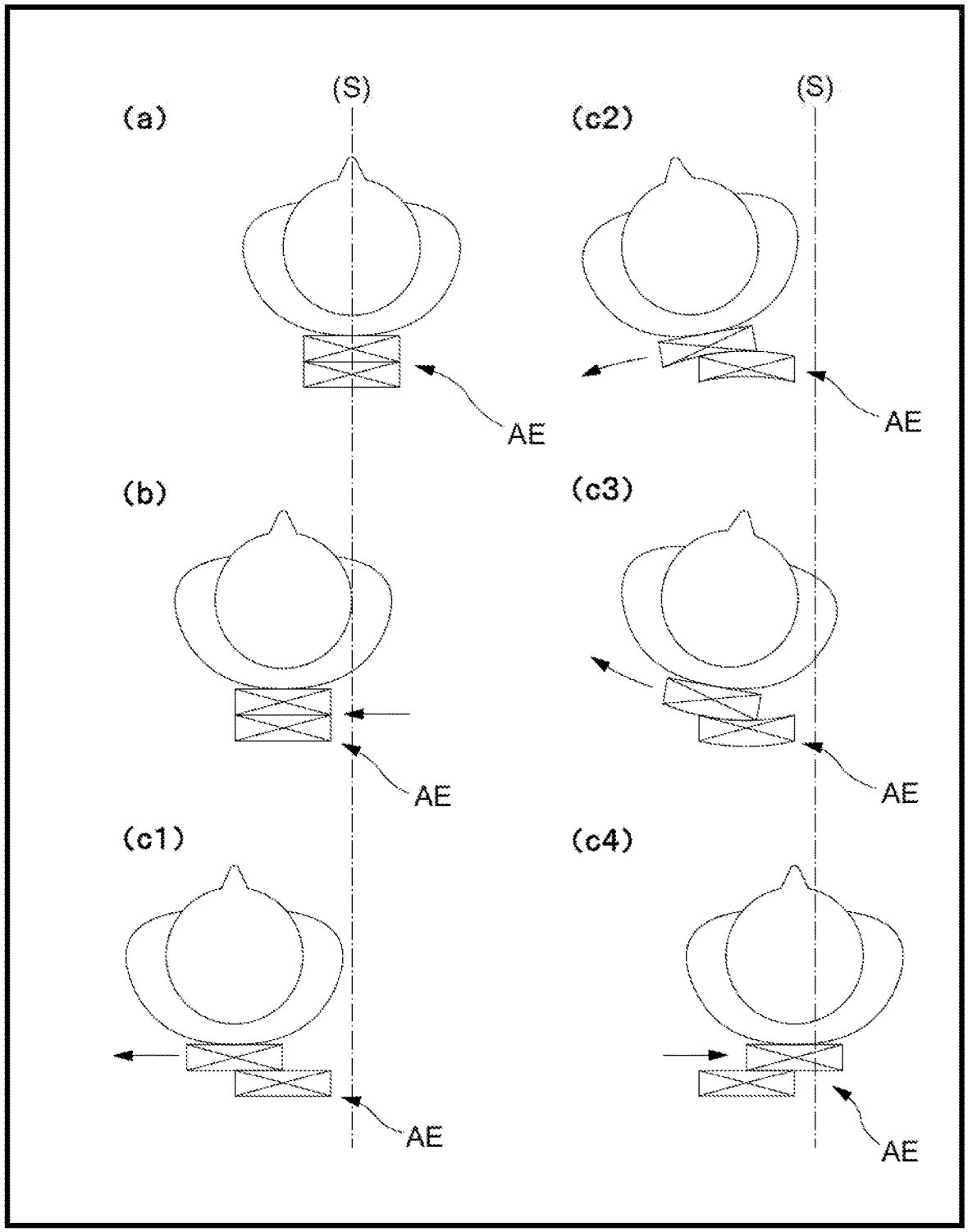
FIG. 12 is conceptual diagrams for describing a function of amplifying a swinging movement in the present invention.

FIG. 12 is conceptual diagrams of an amplification element AE in a plan view in which an upper side in the sheet of FIG. 12 is defined as the front and a lower side in the sheet thereof is defined as the rear. (a) in FIG. 12 illustrates a state where the seat 5 and the backrest 6 are at the reference position (S) in the left-right direction. The seat 5 and the backrest 6 move from this state, for example, as illustrated in (b) in FIG. 12, to the left by the support mechanism SM illustrated in FIG. 3 and the like, and further, the movement of the seat 5 and the backrest 6 is amplified by the amplification element AE so that the seat 5 and the backrest 6 move as illustrated in (c1) to (c4) in FIG. 12. (c1) illustrates a state where the movement is amplified in the same direction, and (c2) illustrates a state where the movement is amplified along an arc. (c3) illustrates a state where the movement is amplified along the arc same as in (c2), but in a direction different from that of (c2). (c4) illustrates a negative amplification, that is, a movement in a direction where the amount of movement of the seat 5 and the backrest 6 is reduced. Other modes of movement may of course be employed.

Among these, in the present embodiment, an amplification operation similar to the operation in (c2) is realized.

Figure 2:
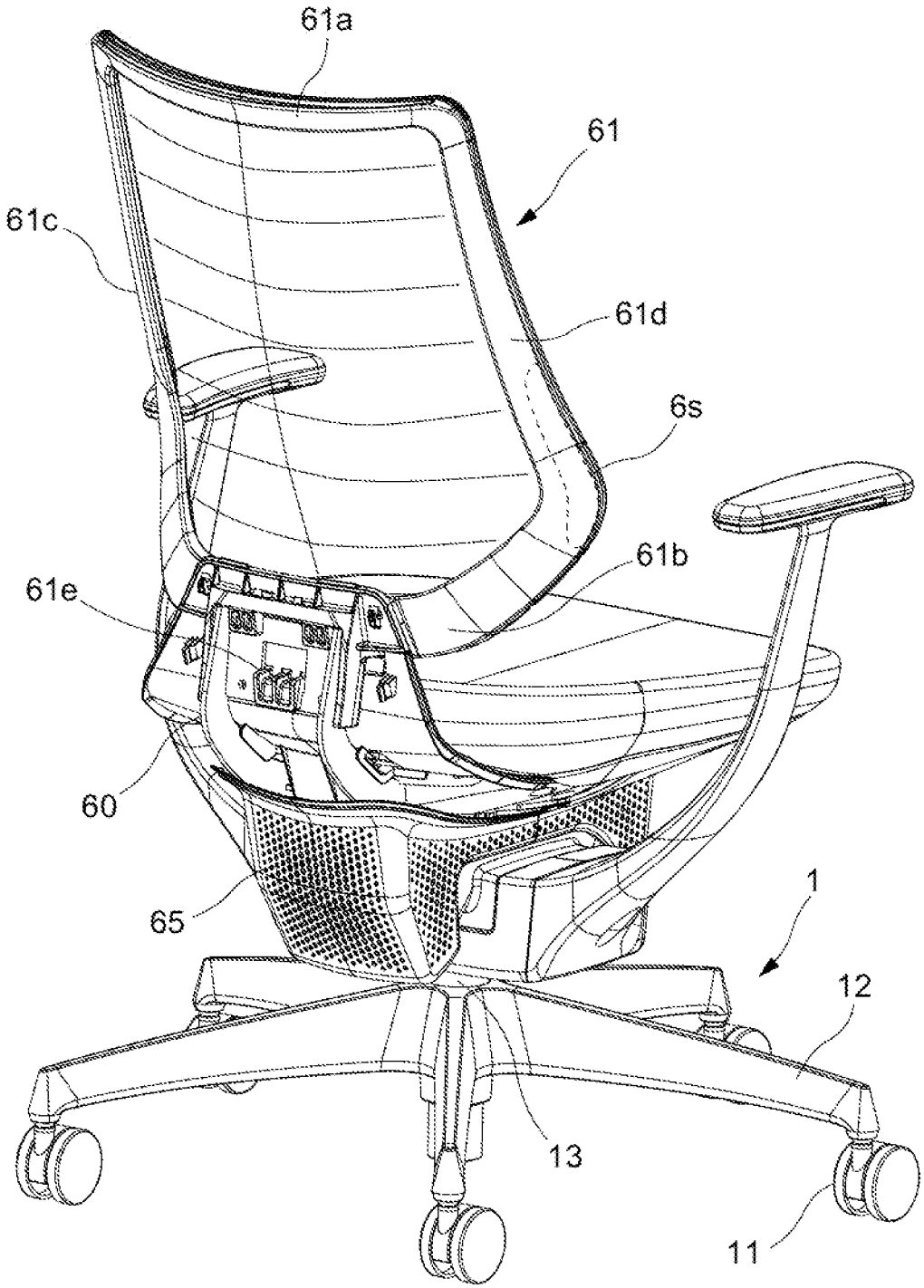
FIG. 2 is a rear perspective view thereof.

That is, as illustrated in FIGS. 1 and 2, the backrest 6 in the present embodiment has a configuration in which horizontal strap bodies 62*y* being an amplification element configured to further amplify a movement operation of the back frame 61 in the left-right direction among movement operations of the back frame 61 are provided on a back frame 61 being a main body, and an aggregated body of the horizontal strap bodies 62*y* forms a pressure receiving surface PS.

Figure 4:
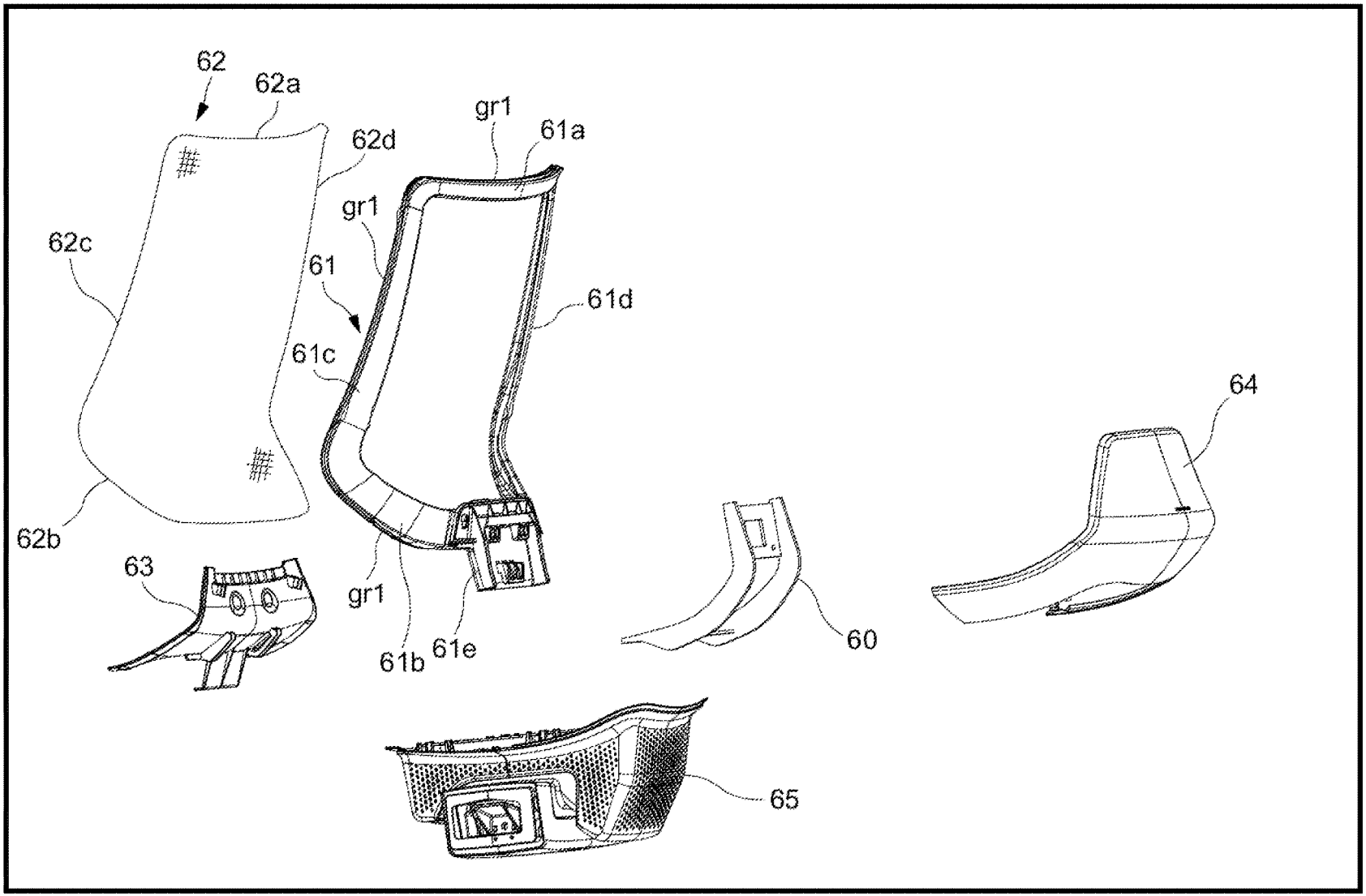
FIG. 4 is an exploded perspective view of FIG. 2.

The back frame 61 has a shape encircled by an upper frame 61*a*, a lower frame 61*b*, and left and right side frames 61*c* and 61*d*, an opening 80*op* is formed in a center of the back frame 61, and grooves gr1 illustrated in FIG. 4 are formed in an outer peripheral edge of the upper frame 61*a*, a part of the lower frame 61*b*, and the left and right side frames 61*c* and 61*d* (see FIG. 4).

In the present embodiment, to realize the pressure receiving surface PS formed of the horizontal strap bodies 62*y* by using an easily obtainable member, a mesh fabric 62 being an upholstery material having flexibility with low stretchability is adopted. As illustrated in FIG. 1, the mesh fabric 62 has a configuration in which M vertical strap bodies 62*z* and N of the horizontal strap bodies 62*y* are weaved in a required length in accordance with a relative position with respect to the frames 61*c* and 61*d* (the frames 61*a* and 61*b*) and a distance between the frames 61*c* and 61*d* (between the frames 61*a* and 61*b*) at each position. As illustrated in FIG. 4, an upper edge 62*a*, a part of a lower edge 62*b*, and left and right side edges 62*c* and 62*d* of the mesh fabric 62 are fitted into grooves of the upper frame 61*a*, the lower frame 61*b*, and the left and right side frames 61*c* and 61*d* included in the back frame 61, to attach the mesh fabric 62 to the back frame 61.

In an attached state illustrated in FIG. 1, a large number of the horizontal strap bodies 62*y* arranged along lines of the left and right side frames 61*c* and 61*d*, and a large number of the vertical strap bodies 62*z* arranged along lines of the upper frame 61*a* and the lower frame 61*b* are intertwined and bound together at each intersection point to be changed to an appropriate line, as a result of which a surface in which the horizontal strap bodies 62*y* and the vertical strap bodies 62*z* are connected forms as a whole the pressure receiving surface PS having a three dimensional shape that faces to the front and envelops a back of a seated person.

The present invention can of course also be realized by an amplification element having a configuration in which only belt-shaped horizontal strap bodies, but no vertical strap bodies, are provided, a configuration in which the horizontal strap bodies have a larger width than the vertical strap bodies and a configuration in which the number of vertical strap bodies is much smaller than the number of horizontal strap bodies.

As illustrated in FIGS. 1, 2, and 4, a mounting unit 61*e* provided on the lower frame 61*b* of the back frame 61 is attached to the back frame 60, and further, a front cover 63 and a rear cover 64 are attached to the front and rear of the mounting unit 61*e*. It is noted that the rear cover 64 is omitted in FIG. 2.

In a main body unit 51 of the seat 5, a cushion material is arranged on an outer cover via an unillustrated inner cover and the entire main body unit 51 and outer cover are covered with an upholstery fabric 50.

Figure 11:
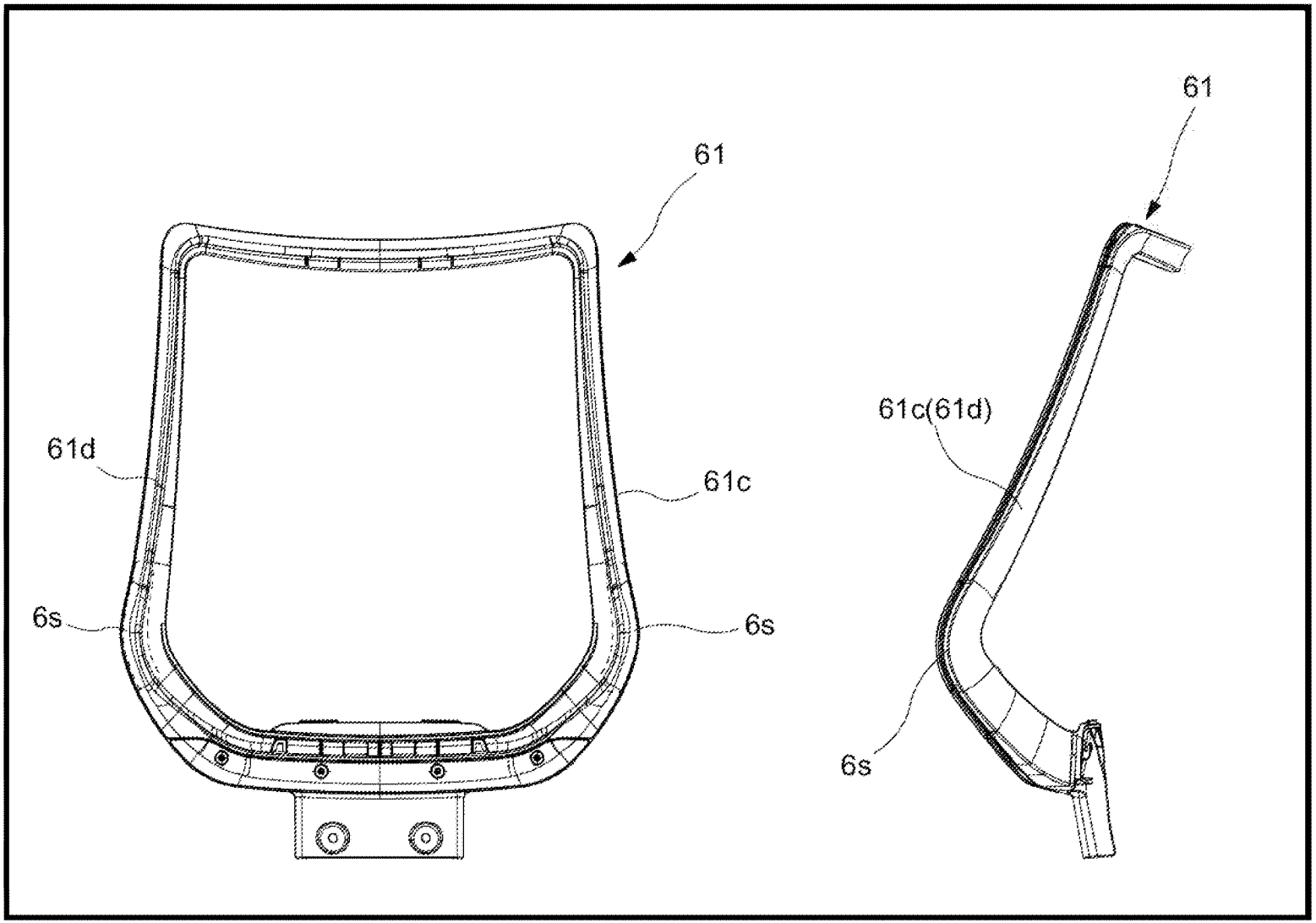
FIG. 11 is a front view and a side view of a back frame in the same embodiment.

As illustrated in FIG. 11, a portion indicated by a broken line 6*s* in the drawing is an intermediate protrusion provided in the back frame 61. The intermediate protrusion 6*s* is configured to partially raise, toward the front, a portion other than ends of the left-right pair of side frame units 61*c* and 61*d* extending obliquely upward and downward so as to form the back frame 61. The intermediate protrusion 6*s* is provided at a height position corresponding to a lumbar region of a seated person having an average physique, and as illustrated in FIG. 11, this portion protrudes furthest to the front in a side view and this portion has also the widest width in the left-right direction in a front view.

Figure 13:
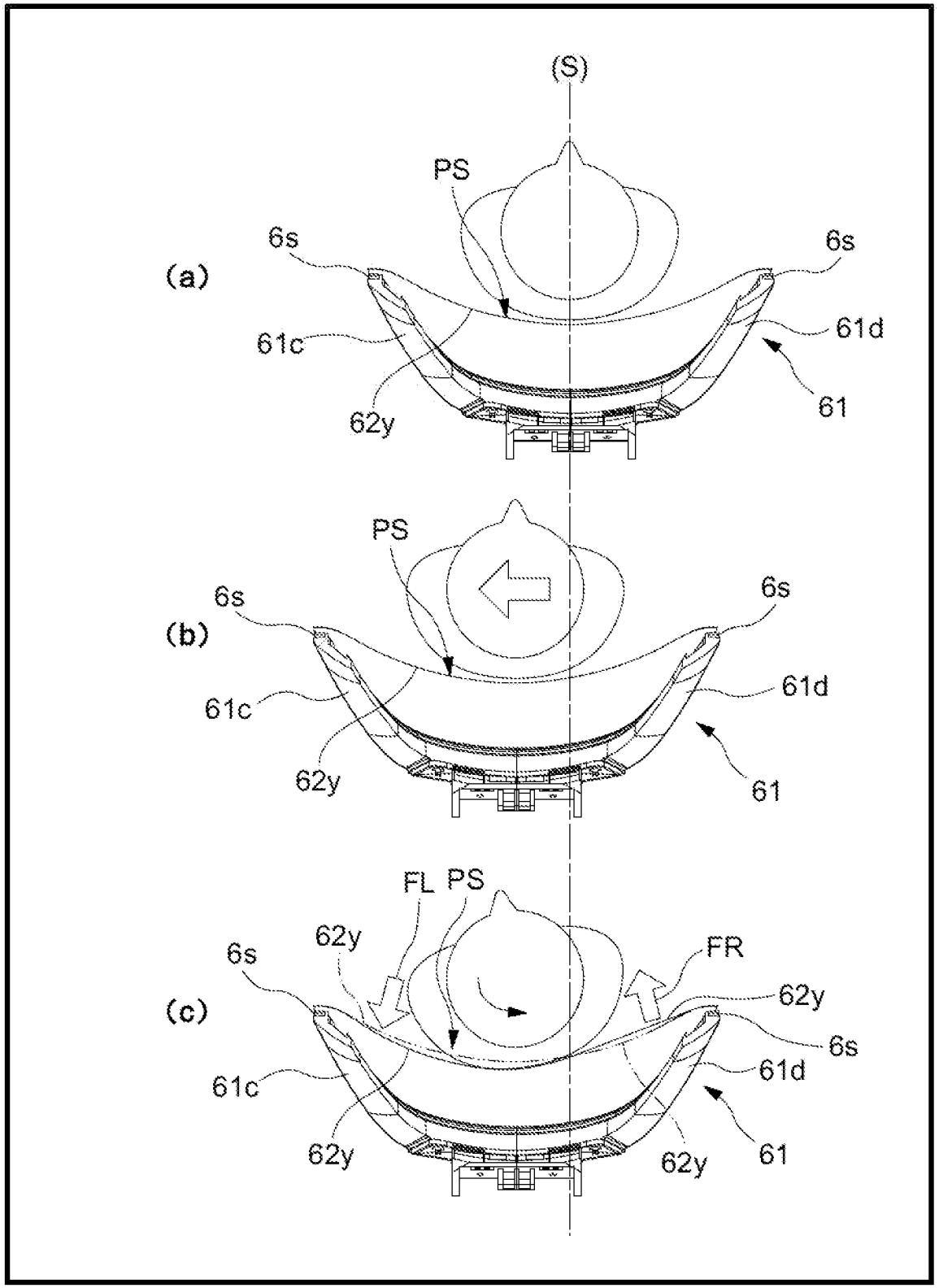
FIG. 13 is explanatory diagrams illustrating operations for describing the function of amplifying the swinging movement in the same embodiment.

Here, an amplification function provided by the horizontal strap bodies 62*y* will be described. As illustrated in FIG. 13, in a plan view in which an upper side in the sheet of FIG. 13 is defined as the front and a lower side in the sheet thereof is defined as the rear, a case is described where a seated person performs an operation of moving his/her body weight to the left, for example. At this time, as illustrated in FIGS. 5 to 7, the left-right support unit 4 moves to the left while raising the center of gravity G of the seat 5 and inclining the tip side of the seat 5 in the movement direction downward. At this time, as illustrated in FIG. 3, the front-rear support unit 3 is supported by the left-right support unit 4 and the backrest 6 is attached to the front-rear support unit 3, and thus, the backrest 6 moves in conjunction with the movement of the seat 5 to the left, as illustrated in (a) and (b) in FIG. 13.

Such a movement to the left may be triggered without the seated person leaning against the backrest 6. However, if the movement to the left is triggered in a state where the seated person leans against the backrest 6, the seated person sometimes involves an operation of twisting an upper body of the seated person to the left, as illustrated in (c) in FIG. 13. In this case, the operations of (b) and (c) in FIG. 13 are typically triggered simultaneously.

Thus, as illustrated in FIG. 13(*c*). the backrest 6 receives a load FL, concentrated on a part of a pressure receiving surface at the left of the center of the pressure receiving surface. In this case, if the horizontal strap bodies 62*y* have low stretchability and is flexibly deformed, the total length of the horizontal strap bodies 62*y* spanning from a left back side frame 61*c* to a right back side frame 61*d* remains substantially the same. Therefore. for example, if an eccentric load is applied to a region left of the center of the strap bodies 62*y* and the horizontal strap bodies 62*y* move backward from an imaginary line in the drawing to a position indicated by a solid line, a region right of the center of the horizontal strap bodies 62*y*, on the other hand, move forward from an imaginary line hi the drawing to a position indicated by a solid line and generates a repulsive force FR pushing the seated person forward.

Figure 14:
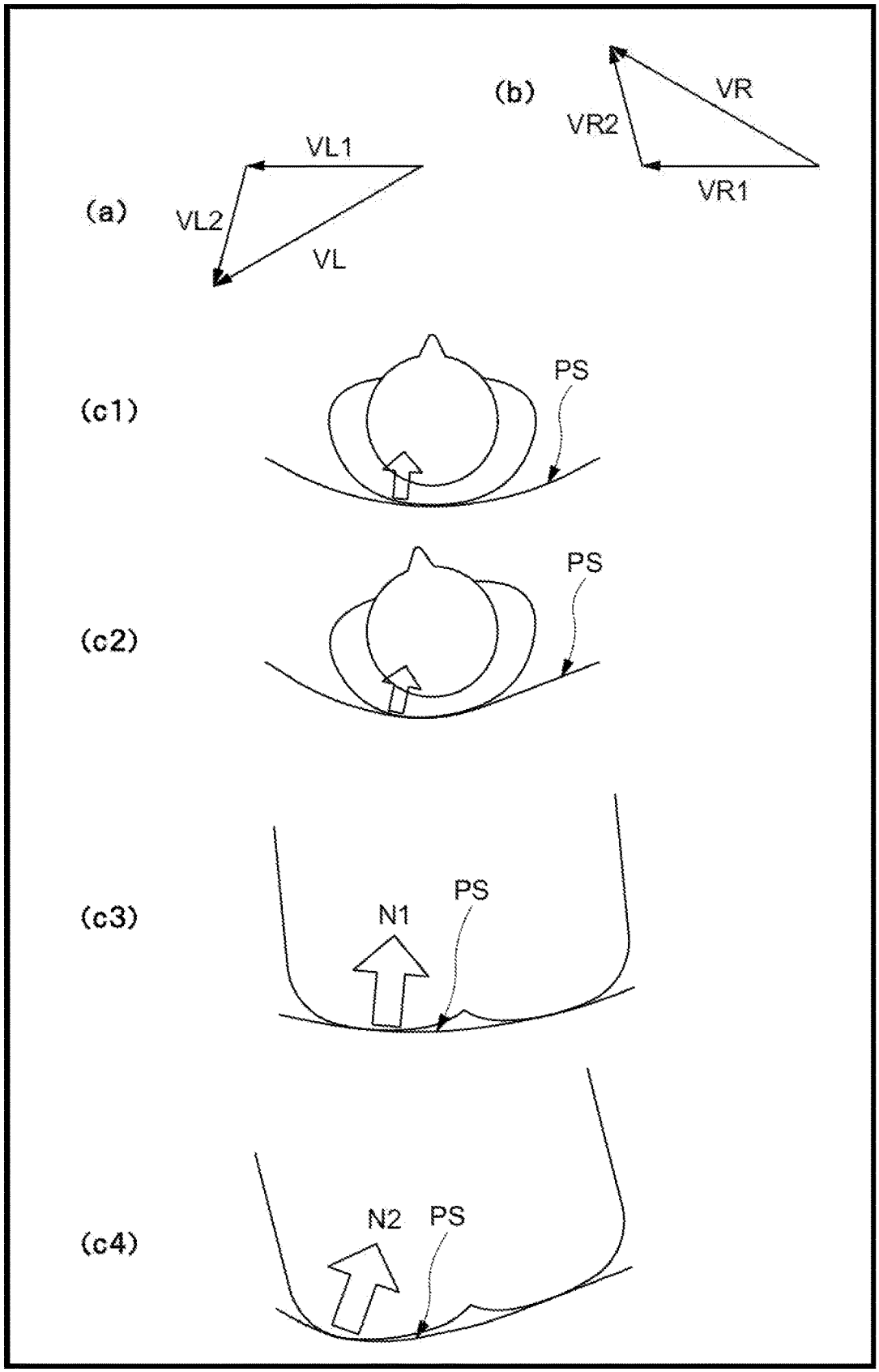
FIG. 14 is explanatory diagrams illustrating operations for describing the function of amplifying the swinging movement in the same embodiment.

In terms of vectors, as illustrated in (a) in FIG. 14, in a region left of the center, the movement of the pressure receiving surface PS combines a vector VL1 moving leftward and a vector VL2 moving rearward, and results in a vector VL having a larger movement distance obliquely leftward and rearward, and thus, a swinging operation is amplified. Further, as illustrated in (b) in FIG. 14, in a region right of the center, the movement of the pressure receiving surface PS combines a vector VR1 moving rightward and a vector VR2 moving forward, and results in a vector VR having a larger movement distance obliquely leftward and forward, and thus, a swinging operation is amplified. As a result, a left shoulder of the seated person is moved more leftward and rearward and a right shoulder of the seated person is moved more leftward and forward by a swinging movement.

Simultaneously, the surface direction of the pressure receiving surface PS formed of the aggregation of the horizontal strap bodies 62*y* can be freely changed depending on the load received from the seated person, and thus, the seating surface is deformed to fit a body orientation of the seated person while the swinging movement is amplified. For example, in a region left of the center, as illustrated in (c1) and (c2) in FIG. 14, the pressure receiving surface PS deforms flexibly so that a direction of a drag force acting on the seated person changes from N1 to N2, to continue supporting the seated person.

The horizontal strap bodies 62*y* perform an amplification operation in a positive direction for increasing a movement operation in the left-right direction until a certain point, and afterwards, when the deformation is stable, the horizontal strap bodies 62*y* switch to an action of restricting a twisting operation of the seated person.

Further, when the seated person stops the swinging operation in the left-right direction or leaves the seat so that the pressure applied to the pressure receiving surface PS is removed, horizontal strap bodies 61*y* being an amplification element perform, as illustrated in (b) and (a) in FIG. 13, an operation of returning the pressure receiving surface PS to a neutral position being a position at a time when no pressure is received. The horizontal strap bodies 62*y* function as an auxiliary return-force generation unit according to the present invention, in cooperation with the vertical strap bodies 62*z*.

Such an amplification function is also fulfilled in a case where an eccentric load is applied to the right side from the center.

As described above, the chair according to the present embodiment includes the leg 1 erected on a floor surface, the seat 5 arranged above the leg 1, the backrest 6 being provided behind the leg 1 and including the pressure receiving surface PS, and the support mechanism SM arranged below the seat 5 to be interposed between the leg 1 and the seat 5 and configured to movably support the seat 5 in the front-rear or left-right direction along a predetermined trajectory and to downwardly incline a tip side of the seat 5 in the movement direction in accordance with a movement of the seat 5 from the predetermined reference position (S). The support mechanism SM includes the return-force generation unit configured to generate, in accordance with an amount of movement, a return force in a direction in which the seat 5 moved from the reference position (S) in the front-rear or left-right direction is returned to the reference position (S), and is configured to movably support the backrest 6 in the left-right direction together with a movement of the seat 5 in the left-right direction. In this structure, the backrest 6 is characterized in including the back frame 61 being a main body unit, and the horizontal strap bodies 62*y* being an amplification element attached to the back frame 61 and configured to amplify, among movement operations of the back frame 61, a movement operation of the back frame 61 in the left-right direction along vectors VL1 and VR1 to obtain the vectors VL and VR.

This allows for a movement operation of the backrest 6 in the left-right direction beyond an original support range by the support mechanism SM, without changing a configuration or function of the support mechanism SM. Therefore, a movable range of a seated person using the backrest 6 increases in the left-right direction, and thus, it is possible to provide a chair having excellent properties by which a seated person hardly feels exhaustion even if seated for a long time, and also providing a better refreshing effect. Moreover, an amplification operation provided by the horizontal strap bodies 62*y* being the amplification element may occur during an original movement operation of the support mechanism, and thus, it is also easy to ensure an amount of movement without increasing the reaction force.

In this case, if seen from an inertial system moving together with the back frame 61 being the main body unit in the left-right direction, the horizontal strap bodies 62*y* being the amplification element perform an amplification operation independent from the movement of the left-right support unit 4 in the left-right direction, as indicated by the vectors VL2 and VR2.

Therefore, the operation of amplifying the movement is independent, and thus, it is possible to choose an amplification amount and an amplification direction independently from the movement of the back frame 61 being the main body unit in the left-right direction, and increase the degree of freedom of the amplification.

In particular, as can be understood from the fact that the direction of the drag force changes from N1 to N2, the horizontal strap bodies 62*y* being the amplification element perform an amplification operation including a directional component other than the movement operation of the back frame 61 being the main body unit in the left-right direction, and thus, it is possible not only to amplify the operation of the amplification element but also to realize a more appropriate support state with respect to the movement of the seated person.

Specifically, the movement operation of the back frame 61 being the main body unit in the left-right direction is a swinging operation in the left-right direction in a front view, as indicated by the vector VL1 in FIG. 14, and the horizontal strap bodies 62*y* being the amplification element are configured to perform an amplification operation including a turning operation in the left-right direction in a plan view, as illustrated in (c1) and (c2) in FIG. 14, and thus, the chair easily responds to an operation in which the seated person performs a swinging movement in the left-right direction while twisting the upper body in a state where the seated person leans against the backrest 6.

In this case, the horizontal strap bodies 62*y* being the amplification element perform, in accordance with a twisting operation of the seated person, an amplification operation in a positive direction to increase the movement operation in the left-right direction until a certain point, and afterwards, act as an element restricting a further twisting operation of the seated person. Therefore, an appropriate support state can be maintained in an end region of the movable range.

As described above, in the present embodiment, the flexibly deformable horizontal strap bodies 62*y* arranged along the left-right direction are provided as the amplification element, and at least an aggregated body of the horizontal strap bodies 62*y* is configured to form the pressure receiving surface PS, and thus, an amplification operation with respect to the movement of the back frame 61 being the main body unit can be appropriately performed as an independent operation different from a swinging movement in the left-right direction.

More specifically, the horizontal strap bodies 62*y* are engaged with the plurality of flexibly deformable vertical strap bodies 62*z* arranged along the left and right side frames 61*c*, at a center portion in the left-right direction and at a position displaced in the left-right direction from the center portion, and an aggregated body of the horizontal strap bodies 62*y* and the vertical strap bodies 62*z* is used as the pressure receiving surface PS, and thus, it is possible to use the mesh fabric 62 in which vertical strap bodies and horizontal strap bodies are alternately woven in advance.

Subsequently, a configuration is such that the vertical strap bodies 62*z* and the horizontal strap bodies 62*y* are arranged in an opening 61*op* of the back frame 61 included in the main body unit, and thus, an amplification operation of the strap bodies 62*z*, 62*y* can be appropriately performed by utilizing the thickness of the back frame 61.

Further, side supports 6*s* protruding toward the seated person are provided in left and right side edges 61*c*, 61*d* of the back frame 61 included in the backrest 6, and thus, when the seated person strongly rocks the seat 5 and the backrest 6, it is possible to appropriately support the seated person so that the seated person does not lose weight balance and perceives a feeling of security.

From a different point of view, the main body unit includes the back frame 61 being a frame body including the left-right pair of side frame 61*c* and 61*d* extending in parallel, and the side frame units 61*c* and 61*d* include the intermediate protrusions 6*s* protruding furthest toward the seated person at positions other than both ends in the extending direction of the side frame units 61*c* and 61*d*. Assuming that FIG. 13 is a plan cross-sectional view corresponding to the height position in the vicinity of a lumbar region of a seated person, the amplification element is formed by spanning the mesh fabric 62 in which the horizontal strap bodies 62*y* and vertical strap bodies 62*x* are previously woven, in a portion between at least the intermediate protrusions 6*s* and 6*s* of the left and right side frame units 61*c* and 61*d*. Thus, the mesh fabric 62 preferentially abuts against the seated person in the portion where the mesh fabric 62 is spanned between the intermediate protrusions 6*s* and 6*s*, and thus, the load of the seated person is easily received locally in this portion and the deformation from the received load increases the tension around the seated person. Therefore, an effect of amplifying the movement of the body of the seated person in the left-right direction is intensified. For this reason, the seated person can perceive a feeling of being inclined more than the inclination of the backrest 6. The intermediate protrusions 6*s* and 6*s* are side supports supporting the inclined body of the seated person from the side via the mesh fabric 62, and thus, the intermediate protrusions 6*s* and 6*s* can effectively prevent the seated person from losing balance.

The horizontal strap bodies 61*y* being the amplification element also serve as a return-force generation part configured to return the pressure receiving surface PS to a neutral position being a position of the pressure receiving surface PS when the pressure on the pressure receiving surface PS is removed, and thus, the horizontal strap bodies 61*y* are always reset to an initial position.

Second Embodiment

Next, a second embodiment of the present invention will be described with reference to FIG. 15 to FIG. 17. In the first embodiment, the amplification element is provided in the backrest 6, but in the present embodiment, the amplification element is provided in a seat 105.

Basic configurations of the leg 1, the support base unit 2, and the support mechanism SM including the front-rear support unit 3 and the left-right support unit 4 are similar to those in the first embodiment described above. Therefore, common portions are referred to by the same reference numerals and description thereof will be omitted.

Figure 16:
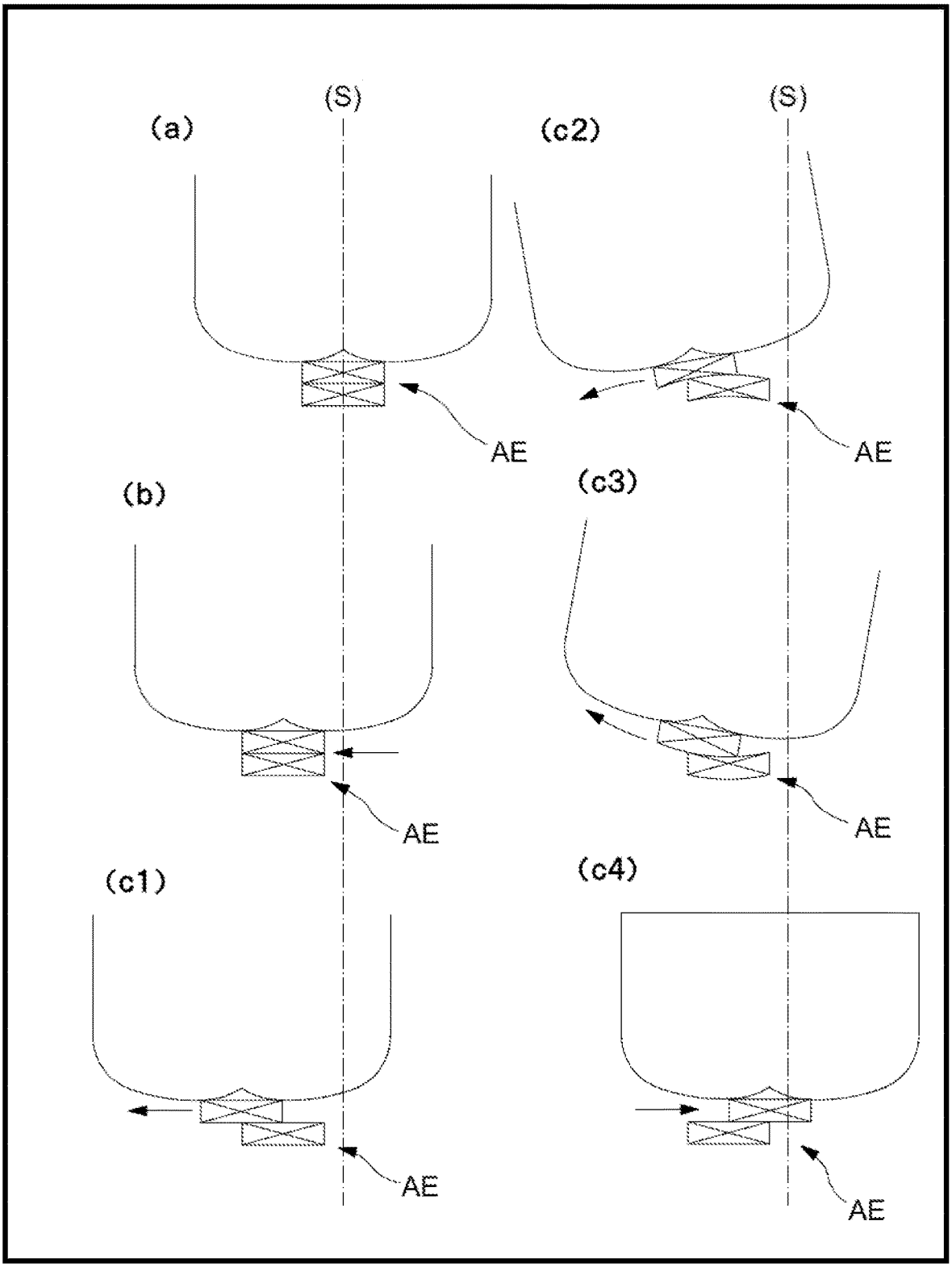
FIG. 16 is conceptual diagrams for describing a function of amplifying a swinging movement in the present invention.

FIG. 16 is a conceptual diagram of the amplification element AE corresponding to FIG. 12. (a) in FIG. 16 illustrates a state where the seat 105 and a backrest 106 are at the reference position (S) in the left-right direction. The seat 105 and the backrest 106 move from this state, for example, as illustrated in (b) in FIG. 16, to the left by the support mechanism SM, and further, the movement of the seat 105 is amplified by the amplification element AE, as illustrated in (c1) to (c4) in FIG. 16, for example. (c1) illustrates a state where the movement is amplified in the same direction, and (c2) illustrates a state where the movement is amplified along an arc. (c3) illustrates a state where the movement is amplified along the arc same as in (c2), but in a direction different from that of (c2). (c4) illustrates a negative amplification, that is, a movement in a direction where the amount of movement of the seat and the backrest is reduced. Other modes of movement may of course be employed.

Among these, an amplification as illustrated in (c2) is realized in the present embodiment.

Figure 15:
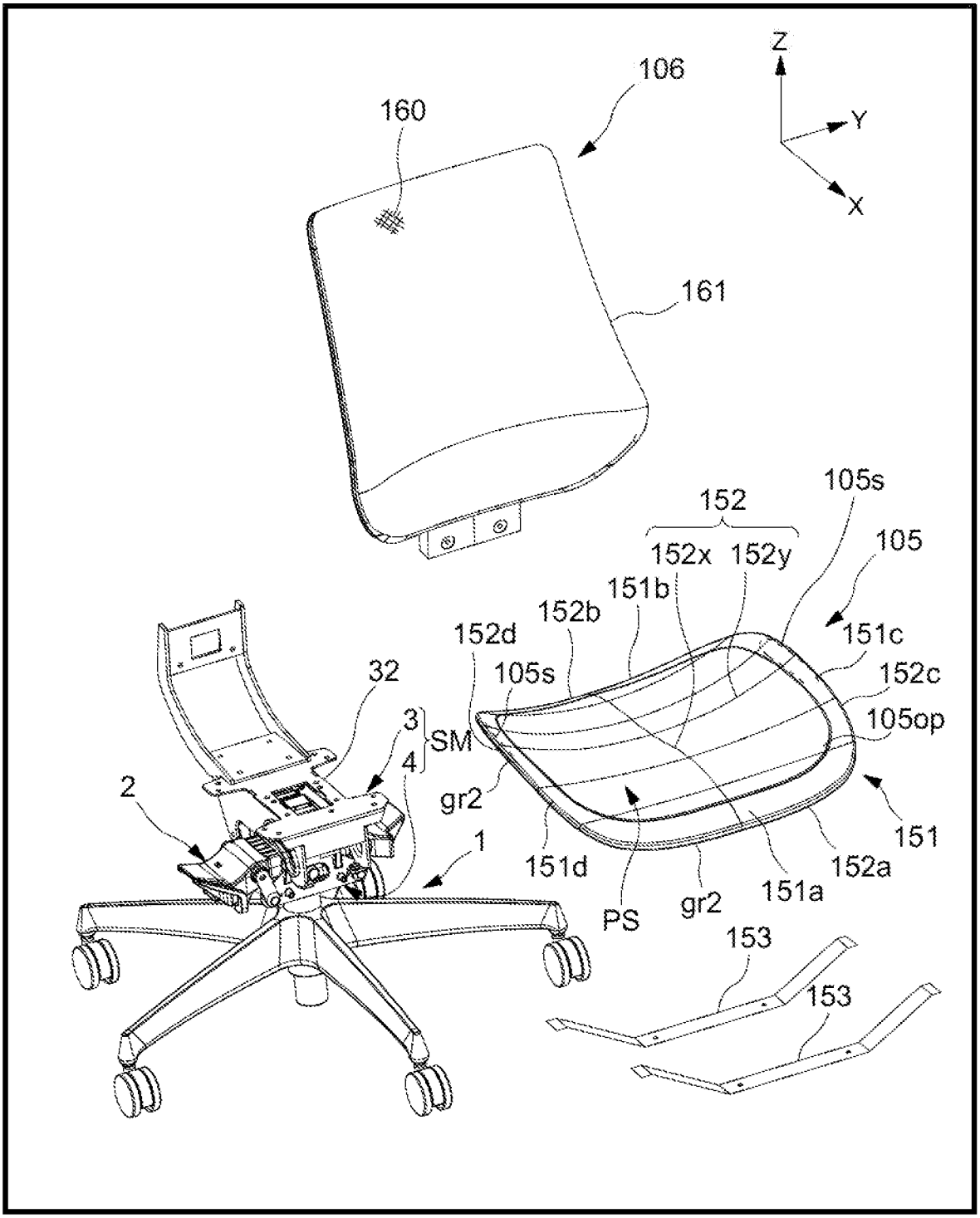
FIG. 15 is an exploded perspective view of a chair according to a second embodiment of the present invention.

As illustrated in FIG. 15, the seat 105 includes a seat frame 151 being a main body, and horizontal strap bodies 152*y* being attached to the seat frame 151 and being an amplification element configured to further amplify a movement operation of the seat frame 151 in the left-right direction among movement operations of the seat frame 151.

The seat frame 151 has a shape encircled by a front frame 151*a*, a rear frame 151*b*, and left and right side frames 151*c* and 151*d*, an opening 105*op* is formed in a center of the seat frame 151, and grooves gr2 are formed on an outer peripheral edge of the front frame 151*a*, the rear frame 151*b*, and the left and right side frames 151*c* and 151*d*.

Also in the present embodiment, to realize the pressure receiving surface PS formed of the horizontal strap bodies 152*y* by using an easily obtainable member, a mesh fabric 152 being an upholstery material having flexibility with low stretchability is adopted. The mesh fabric 152 has a configuration in which J vertical strap bodies 152*x* and K of the horizontal strap bodies 152*y* are weaved in a required length in accordance with a relative position with respect to the frames 151*c* and 151*d* (the frames 151*a* and 151*b*) and a distance between the frames 151*c* and 151*d* (between the frames 151*a* and 151*b*) at each position. A front edge 152*a*, a rear edge 152*b*, and left and right side edges 152*c* and 152*d* of the mesh fabric 152 are fitted into the grooves gr2 of an upper frame 151*a*, a lower frame 151*b*, and the left and right side frames 151*c* and 151*d* included in the seat frame 151, to attach the mesh fabric 152 to the seat frame 151.

In such an attached state, the horizontal strap bodies 152*y* arranged along lines of the left and right side frames 151*c* and 151*d*, and the vertical strap bodies 152*x* arranged along lines of the front frame 151*a* and the rear frame 151*b* are intertwined and bound together at each intersection point to be changed to an appropriate line, as a result of which a surface in which the horizontal strap bodies 152*y* and the vertical strap bodies 152*x* are connected forms as a whole the pressure receiving surface PS having a three dimensional shape that faces upward and envelops a gluteal region of a seated person.

The present invention can of course also be implemented by an amplification element having a configuration in which only belt-shaped horizontal strap bodies, but no vertical strap bodies, are provided, a configuration in which the horizontal strap bodies have a larger width than the vertical strap bodies, and a configuration in which the number of vertical strap bodies is much smaller than the number of horizontal strap bodies.

The left and right side frames 151*c* and 151*d* of the seat frame 151 are attached to the upper connection plate 32 of a front-rear movement unit 3 via brackets 153 bent to open upward. A gap allowing for deformation of the mesh fabric 152 is secured between the mesh fabric 152 and the bracket 153.

In the backrest 106, the main body unit 161 includes a cushion material that is arranged in front of an outer cover via an unillustrated inner cover, and the entire main body unit 161 and outer cover are covered with an upholstery fabric 160.

A portion indicated by a broken line 105*s* in the drawing is an intermediate protrusion provided in the seat frame 151. The intermediate protrusion 105*s* is configured to partially raise upward a portion other than ends of the left-right pair of side frame units 151*c* and 151*d* extending in the front-rear direction to form the seat frame 151, and the intermediate protrusion 105*s* is positioned at a position corresponding to the side of the gluteal region of a seated person having an average physique. The side frame units 151*c* and 151*d* of the seat frame 151 are gently raised in an extending direction of the side frame units 151*c* and 151*d*, but the intermediate protrusion 105*s* may be raised by abruptly changing the curvature of the intermediate protrusion 105*s* in the side frame 151*c* and 151*d*.

Here, an amplification function provided by the horizontal strap bodies 152*y* will be described. As illustrated in FIG. 17, in a rear view in which an upper side in the sheet of FIG. 17 is defined as the upper side and a lower side in the sheet thereof is defined as the lower side, a case is described in which a seated person performs an operation of moving his/her body weight to the left, for example. As illustrated in FIG. 7, the left-right support unit 4 moves to the left while raising the center of gravity G of the seat 5 and inclining the tip side of the seat 5 in the movement direction downward. At this time, the seat 105 moves while being inclined to the left by the support mechanism SM, as illustrated in (a) and (b) in FIG. 17.

Figure 17:
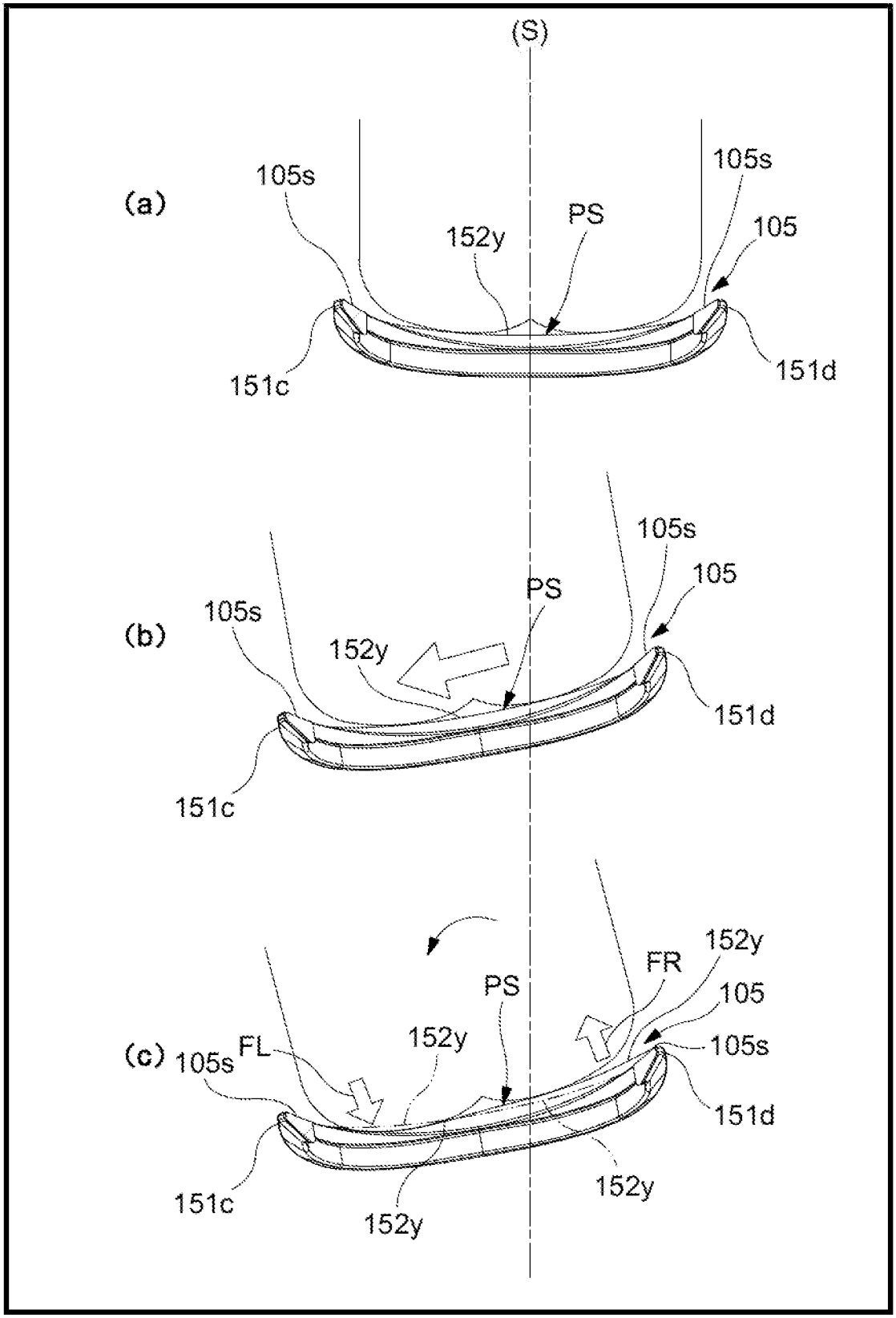
FIG. 17 is operation explanatory diagrams illustrating operations for describing the: function of amplifying the swinging movement in the same embodiment.
Figure 18:
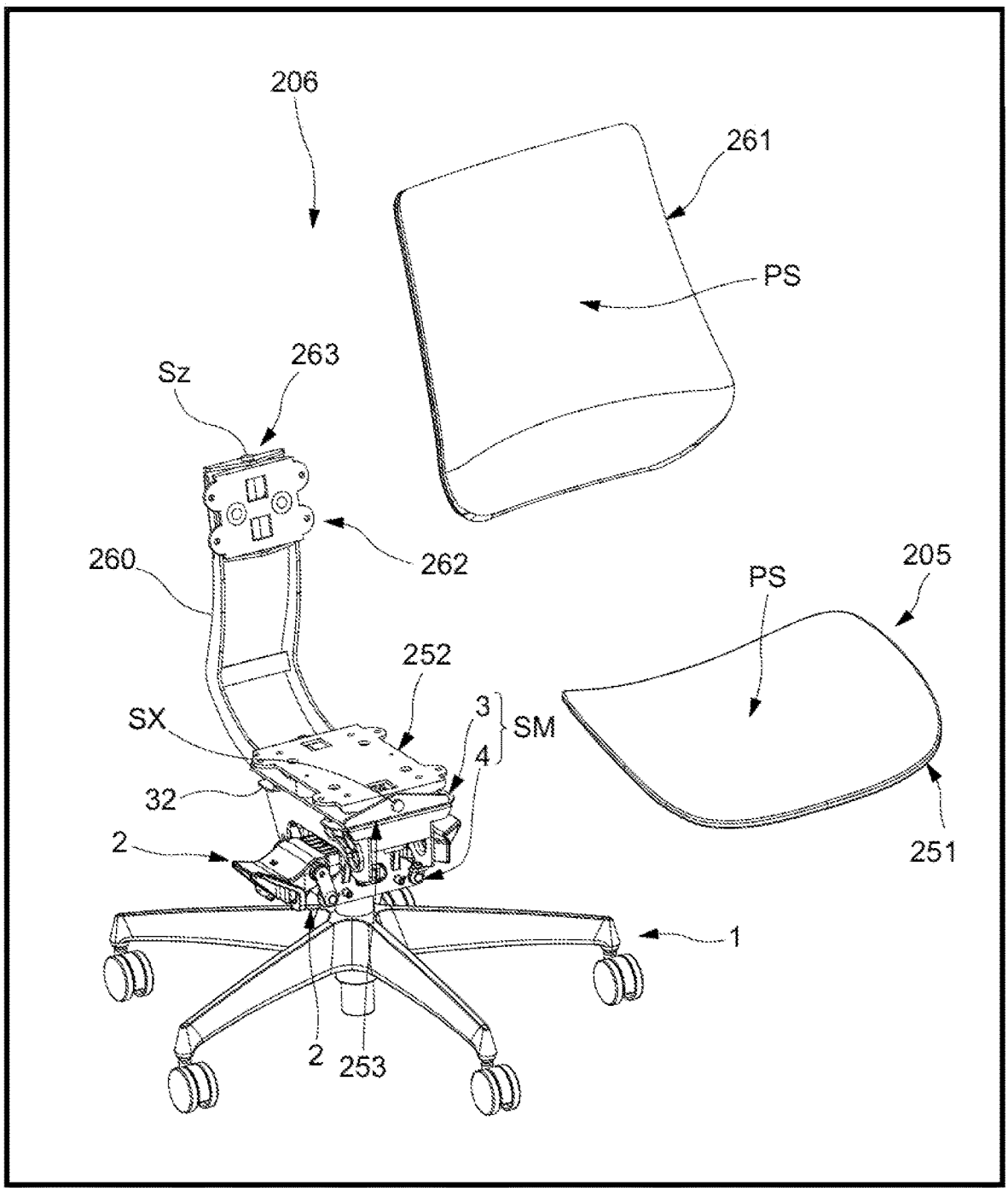
FIG. 18 is an exploded perspective view of a chair according to a third embodiment of the present invention.
Figure 19:
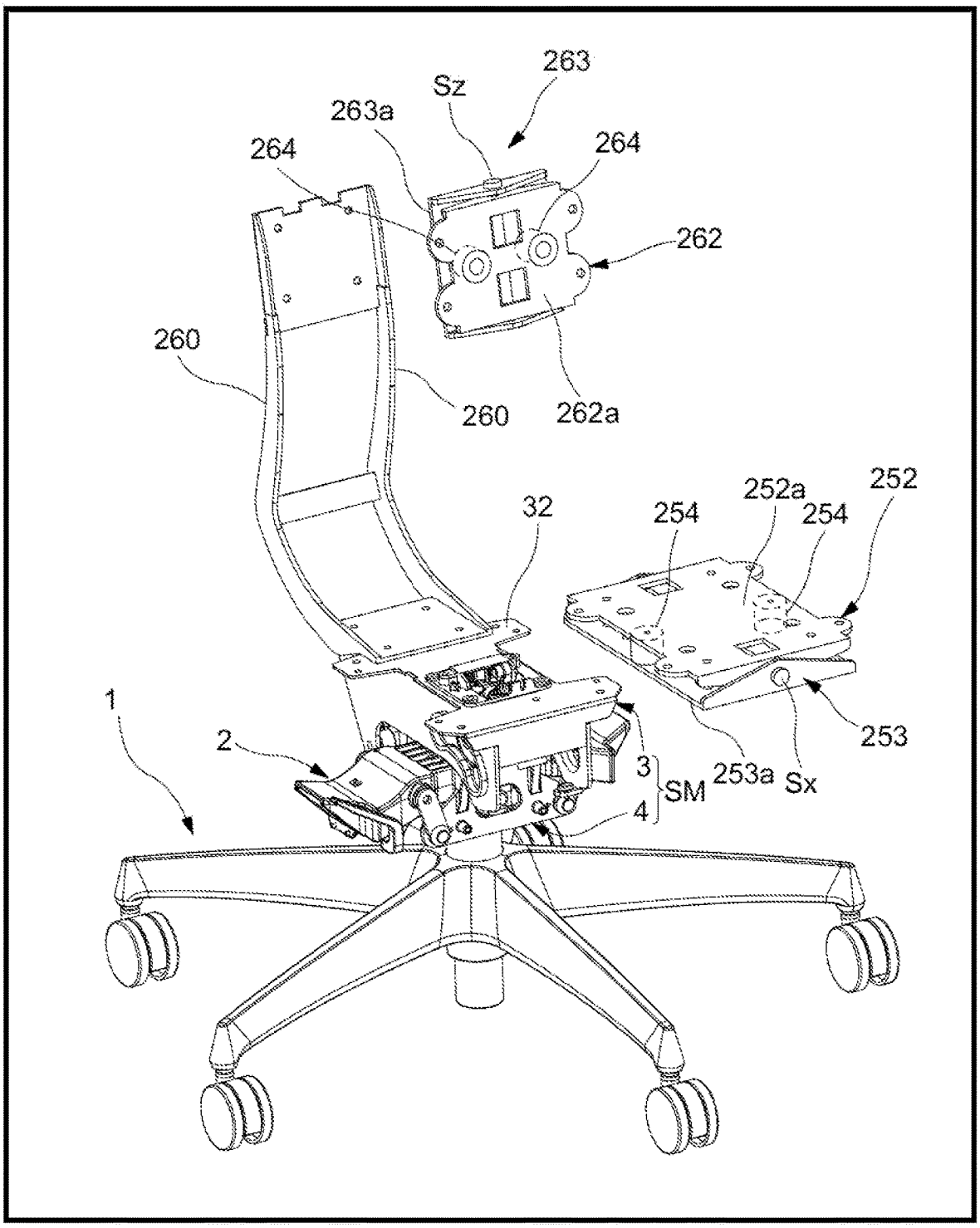
FIG. 19 is a further exploded perspective view of FIG. 18.

Together with this movement, as illustrated in (c) in FIG. 17, the seat 105 receives the load FL concentrated on a part of the pressure receiving surface left of the center of the pressure receiving surface PS. In this case, if the horizontal strap bodies 152*y* have flexibility with low stretchability, the total length of horizontal strap bodies 152*y* spanning from the left seat frame 151*c* to the right seat frame 151*d* remains substantially the same. Therefore, for example, if an eccentric load is applied to a region left of the center of the strap bodies 152*y* and the horizontal strap bodies 152*y* sinks downward, a region right of the center of the horizontal strap bodies 152*y* conversely protrudes upward and generates a repulsive force FR pushing the seated person upward.

In terms of vectors, as illustrated in FIG. 14, in a region left of the center, according to the operation illustrated in (a) in FIG. 14, the movement of the pressure receiving surface combines the vector VL1 moving leftward and the vector VL2 moving downward, and results in the vector VL having a larger movement distance obliquely leftward and downward, and thus, the swinging operation is amplified. Further, according to the operation illustrated in (b) in FIG. 14, in a region right of the center, the movement of the pressure receiving surface combines the vector VR1 moving leftward and the vector VR2 moving upward, and results in the vector VR having a larger movement distance obliquely leftward and upward, and thus, the swinging operation is amplified. As a result, the left side of the body of the seated person is moved more leftward and downward and the right side of the body of the seated person is moved more leftward and upward by a swinging movement.

Simultaneously, the surface direction of the pressure receiving surface PS formed of the aggregation of the horizontal strap bodies 62*y* and the like can be freely changed depending on the load received from the seated person, and thus, the seating surface is deformed to fit a body orientation of the seated person, while the swinging movement is amplified. For example, in a region left of the center, as illustrated in (c3) and (c4) in FIG. 14, a direction of a drag force acting on the seated person is changed from N1 to N2 to continue supporting the seated person.

The horizontal strap bodies 152*y* perform an amplification operation in a positive direction for increasing a movement operation in the left-right direction until a certain point, and afterwards, when the deformation is stable, the horizontal strap bodies 152*y* switch to an action of restricting a twisting operation of the seated person.

When the seated person stops the swinging operation in the left-right direction or leaves the seat so that the pressure applied to the pressure receiving surface PS is removed, the horizontal strap bodies 152*y* being the amplification element perform, as illustrated in (b) and (a) in FIG. 17, an operation of returning the pressure receiving surface PS to a neutral position being a position at a time when no pressure is received. The horizontal strap bodies 152*y* also function as a return-force generation unit according to the present invention, in cooperation with the vertical strap bodies 152*x*.

Such an amplification function is also fulfilled in a case where an eccentric load is applied to the right side from the center.

As described above, the chair according to the present embodiment includes the leg 1 erected on a floor surface, the seat 105 being arranged above the leg 1 and including the pressure receiving surface PS, and the support mechanism SM arranged below the seat 105 to be interposed between the leg 1 and the seat 105 and configured to movably support the seat 105 in the front-rear or left-right direction along a predetermined trajectory and to downwardly incline a tip side of the seat 105 in the movement direction in accordance with a movement of the seat 105 from the predetermined reference position (S). The support mechanism SM includes the return-force generation unit configured to generate, in accordance with an amount of movement, a return force in a direction in which the seat 105 moved from the reference position (S) in the front-rear or left-right direction is returned to the reference position (S). In this structure, the seat 105 is characterized in including the seat frame 151 being a main body unit, and the horizontal strap bodies 152*y* attached to the seat frame 151 and being an amplification element configured to further amplify a movement operation of the seat frame 151 in the left-right direction among movement operations of the seat frame 151.

Even with this structure, it is possible to allow for a movement operation of the seat 105 in the left-right direction beyond an original support range by the support mechanism SM, without changing a configuration or function of the support mechanism SM. Therefore, a movable range of a seated person using the seat 105 increases in the left-right direction, and thus, it is possible to provide a chair having excellent properties by which a seated person hardly feels exhaustion even if seated for a long time, and also providing a better refreshing effect. Moreover, an amplification operation by the amplification element may occur during an original movement operation of the support mechanism, and thus, it is also easy to perform a movement in which an amount of movement is ensured without increasing the reaction force of the support mechanism SM.

In addition thereto, the present embodiment is similar to the embodiment described above in that the horizontal strap bodies 152*y* being the amplification element perform an amplification operation independent from the movement operation of the seat frame 151 being the main body unit or an amplification operation including a directional component different from the movement operation of the seat frame 151, the horizontal strap bodies 152*y* partially perform an operation in a slowing direction, the amplification element is the horizontal strap bodies 152*y*, the horizontal strap bodies 152*y* are engaged with the vertical strap bodies 152*x* to form the pressure receiving surface PS, the vertical strap bodies 152*x* and the horizontal strap bodies 152*y* are arranged in the opening 105*op* of the seat frame 151 being the main body unit, and the seat 105 includes a side support 105*s*, and thus, an operation and effect similar to those in the embodiment described above can be obtained.

In particular, the main body unit includes the seat frame 151 being a frame body including the left-right pair of side frame units 151*c* and 151*d* extending in parallel, and the side frame units 151*c* and 151*d* include the intermediate protrusions 105*s* raised toward the seated person at positions other than both ends in the extending direction of the side frame units 151*c* and 151*d*. Assuming that FIG. 17 is a vertical cross-sectional view corresponding to the side of a gluteal region of a seated person, the amplification element is formed by spanning the mesh fabric 152 in which the horizontal strap bodies 152*y* and the vertical strap bodies 152*x* are previously woven, in a portion between at least the intermediate protrusions 105*s* and 105*s* of the left and right side frame units 151*c* and 151*d*. Thus, the mesh fabric 152 preferentially abuts against the seated person in the portion where the mesh fabric 152 is spanned between the intermediate protrusions 105*s* and 105*s*, and thus, the load of the seated person is easily received locally in this portion and the deformation from the received load increases the tension around the seated person. Therefore, an effect of amplifying the movement of the body of the seated person in the left-right direction is intensified. Therefore, the seated person can perceive a feeling of being inclined more than the inclination of the seat 105. The intermediate protrusions 105*s* and 105*s* serve as side supports supporting the body of the inclined seated person from the side via the mesh fabric 152, and thus, it is possible to effectively prevent the seated person from losing balance.

Third Embodiment

Next, a third embodiment of the present invention will be described with reference to FIG. 18 to FIG. 21. In the first and second embodiments, horizontal strap bodies are used as an amplification element in the backrest or the seat. However, in the present embodiment, rotation parts 262 and 252 being mechanically movable units are provided as amplification elements in a backrest main body 261 or a seat main body 251 via bearings 263 and 253.

Basic configurations of the leg 1, the support base unit 2, and the support mechanism SM including the front-rear support unit 3 and the left-right support unit 4 are similar to those in the embodiments described above. Therefore, common portions are referred to by the same reference numerals and description thereof will be omitted.

That is, the rotation units 262 and 252 in the chair of the present embodiment perform an operation similar to the operations in (c2) in FIGS. 12 and (c2) in FIG. 16, and the rotation units 262 and 252 support the pressure receiving surface PS of a backrest 206 or a seat 205.

First, the rotation unit 262 will be described. The bearing unit 263 includes a vertical shaft Sz being a shaft center extending in the up-down direction orthogonal to the left-right direction of the backrest main body unit 261 and a shaft hole provided in a load receiving unit 263*a* attached to a side of a back frame 260 and in the rotation unit 262, into which the vertical shaft Sz is to be inserted. The load receiving unit 263*a* is connected between upper ends of the pair of back frames 260 and 260, and faces a surface plate 262*a* of the rotation unit 262. An elastic body 264 such as urethane or a coil spring is interposed as an auxiliary return-force generation unit of the present invention between the load receiving unit 263*a* and the surface plate 262*a* at positions displaced in the left-right direction from the vertical shaft Sz.

Subsequently, the backrest main body unit 261 is attached to the surface plate 262*a* of the rotation unit 262. The backrest main body 261 of the present embodiment is similar to a backrest main body unit 161 (see FIG. 15) in the second embodiment described above.

Next, the rotation unit 252 will be described. The bearing unit 253 includes a vertical shaft Sx being a shaft center extending in the front-rear direction orthogonal to the left-right direction of a seat main body unit 251 and a shaft hole provided in a load receiving unit 253*a* attached to a side of the seat 205 and in the rotation unit 252, into which the vertical shaft Sx is to be inserted. The load receiving unit 253*a* is connected to the upper connection plate 32 of the front-rear movement unit 3 supporting the seat 205, and faces a surface plate 252*a* of the rotation unit 252. An elastic body 254 such as urethane or a coil spring is interposed as an auxiliary return-force generation unit of the present invention between the load receiving unit 253*a* and the surface plate 252*a* at positions displaced in the left-right direction from a front-rear shaft Sz.

Subsequently, the seat main body unit 251 is attached to the surface plate 252*a* of the rotation unit 252. The seat main body 251 of the present embodiment is similar to the seat main body unit 51 (see FIG. 1) in the first embodiment described above.

Figure 20:
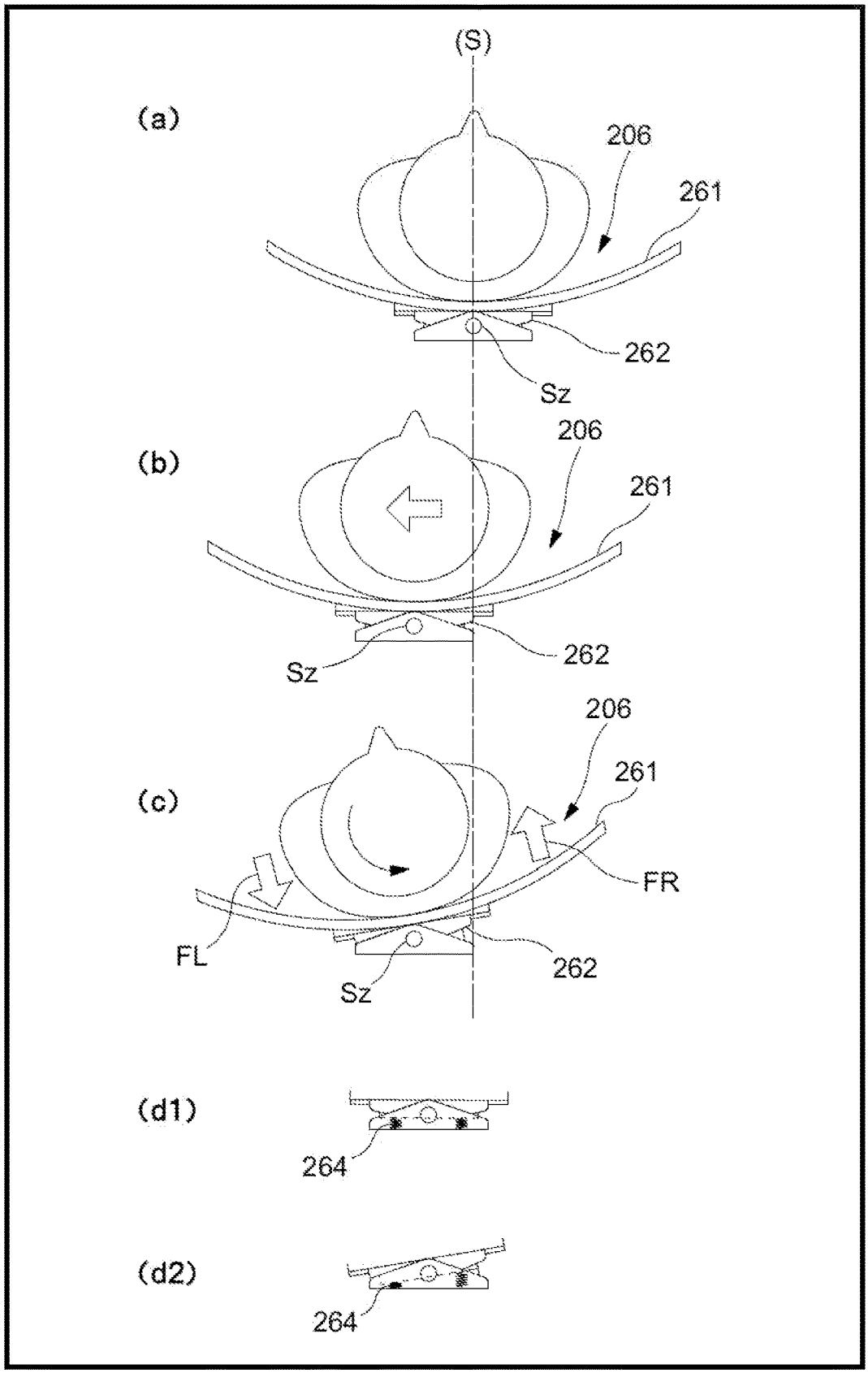
FIG. 20 is explanatory diagrams illustrating operations for describing a function of amplifying a swinging movement in the same embodiment.

If the seated person performs an operation of moving his/her body weight to the left while twisting the upper body, similarly to in the first embodiment, the backrest 206 also moves to the left in conjunction with the movement of the seat, as illustrated in (a) and (b) in FIG. 20.

Together with this movement, if the seated person performs an operation of twisting his/her upper body as illustrated in (c) in FIG. 20, the load FL is applied concentrated on a part of the pressure receiving surface PS left of the center of the backrest 206, and the rotation unit 262 rotates in a plan view to the left around the shaft Sz, and thus, the part of the pressure receiving surface PS left of the center retreats and a part of the pressure receiving surface PS right of the center moves forward by the repulsive force FR.

Also in this case, in terms of vectors, the movement combines vectors similar to the vectors VL and VR illustrated in FIG. 14 to amplify the swinging operation. As a result, a left shoulder of the seated person is moved more leftward and rearward and a right shoulder of the seated person is moved more leftward and forward by a swinging movement.

If the rotation unit 262 performs such an amplification operation, the elastic body 264 being the return-force generation unit accumulates a return force.

Thus, when the seated person stops the swinging operation in the left-right direction or leaves the seat so that the pressure applied to the pressure receiving surface PS is removed, the rotation unit 262 being the amplification element performs, as illustrated in (b) and (a) in FIG. 20, an operation of returning the pressure receiving surface to a neutral position being a position at a time when no pressure is received.

The operation described above is also performed in a case where an eccentric load is applied to the right side from the center.

The above description also applies to the seat 205. That is, if the seated person performs an operation of moving his/her body weight to the left, similarly to in the first embodiment, as illustrated in FIG. 7, the left-right support unit 4 moves to the left while raising the center of gravity G of the seat 5 and inclining the tip side of the seat 5 in the movement direction downward. At this time, the seat 205 is moved in a rear view to the left by the support mechanism SM, as illustrated in (a) and (b) in FIG. 21.

Together with this movement, if the load FL is applied concentratively to a part of the pressure receiving surface PS left of the center of the seat 205, the rotation unit 252 rotates in a rear view to the left around the shaft Sx, and thus, the part of the pressure receiving surface PS left of the center retreats and a part of the pressure receiving surface PS right of the center moves forward by the repulsive force FR.

Also in this case, in terms of vectors, the movement combines vectors similar to the vectors VL and VR illustrated in FIG. 14 to amplify the swinging operation. As a result, the seated person experiences a stronger swinging movement to the left and rear.

If the rotation unit 252 performs such an amplification operation, the elastic body 254 being the return-force generation unit accumulates a return force.

Figure 21:
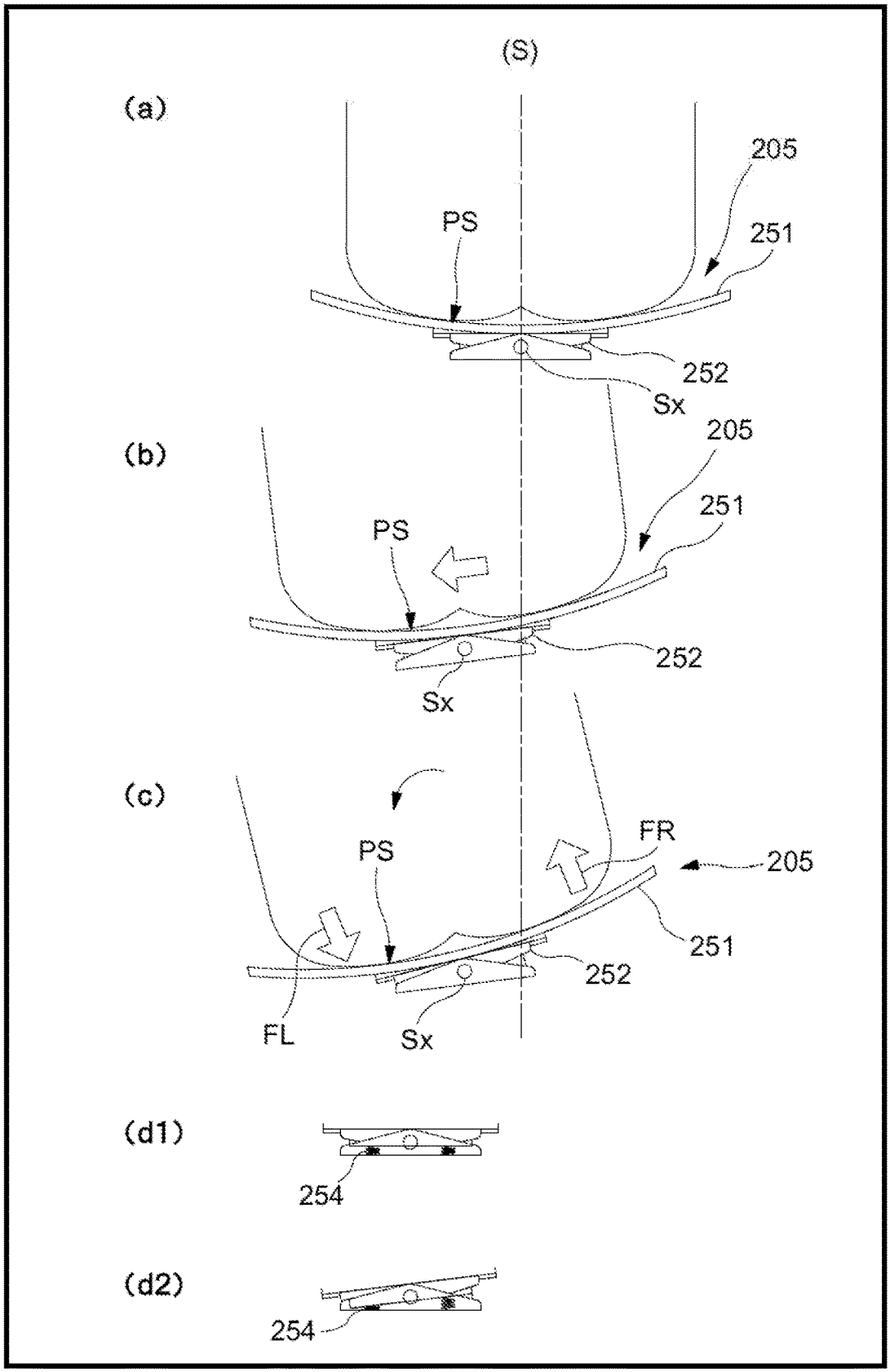
FIG. 21 is explanatory diagrams illustrating operations for describing the function of amplifying the swinging movement in the same embodiment.

Thus, when the seated person stops the swinging operation in the left-right direction or leaves the seat so that the pressure applied to the pressure receiving surface is removed, the rotation unit 252 being an amplification element performs, as illustrated in (b) and (a) in FIG. 21, an operation of returning the pressure receiving surface PS to a neutral position being a position at a time when no pressure is received.

The operation described above is also performed in a case where an eccentric load is applied to the right side from the center.

In addition to a basic operation and effect realized by providing the amplification element, this configuration is similar to that in the first and second embodiments described above in that the rotation units 262 and 252 being the amplification elements perform an amplification operation independent from the movement operation of the main body units 261 and 251 or an amplification operation including a directional component different from the movement operation of the main body units 261 and 251, partially perform an operation in a slowing direction, and include a side support, and thus, even with this configuration, an operation and effect similar to those in the first and second embodiments can be obtained.

In particular, if the rotation units 262 and 252 are provided, it is possible to specifically set a rotation radius and the like.

Fourth Embodiment

Next, a fourth embodiment of the present invention will be described with reference to FIG. 22 to FIG. 25. In the first to third embodiments, the swinging operation of the backrest and the seat in the left-right direction is amplified by a one-step amplification element, but the present embodiment is different from the first to third embodiments in that the swinging operation of a backrest 306 in the left-right direction is amplified in two steps by a first amplification element AE1 and a second amplification element AE2.

Basic configurations of the leg 1, the support base unit 2, and the support mechanism SM including the front-rear support unit 3 and the left-right support unit 4 are similar to those in the embodiments described above. Therefore, common portions are referred to by the same reference numerals and description thereof will be omitted.

Figure 23:
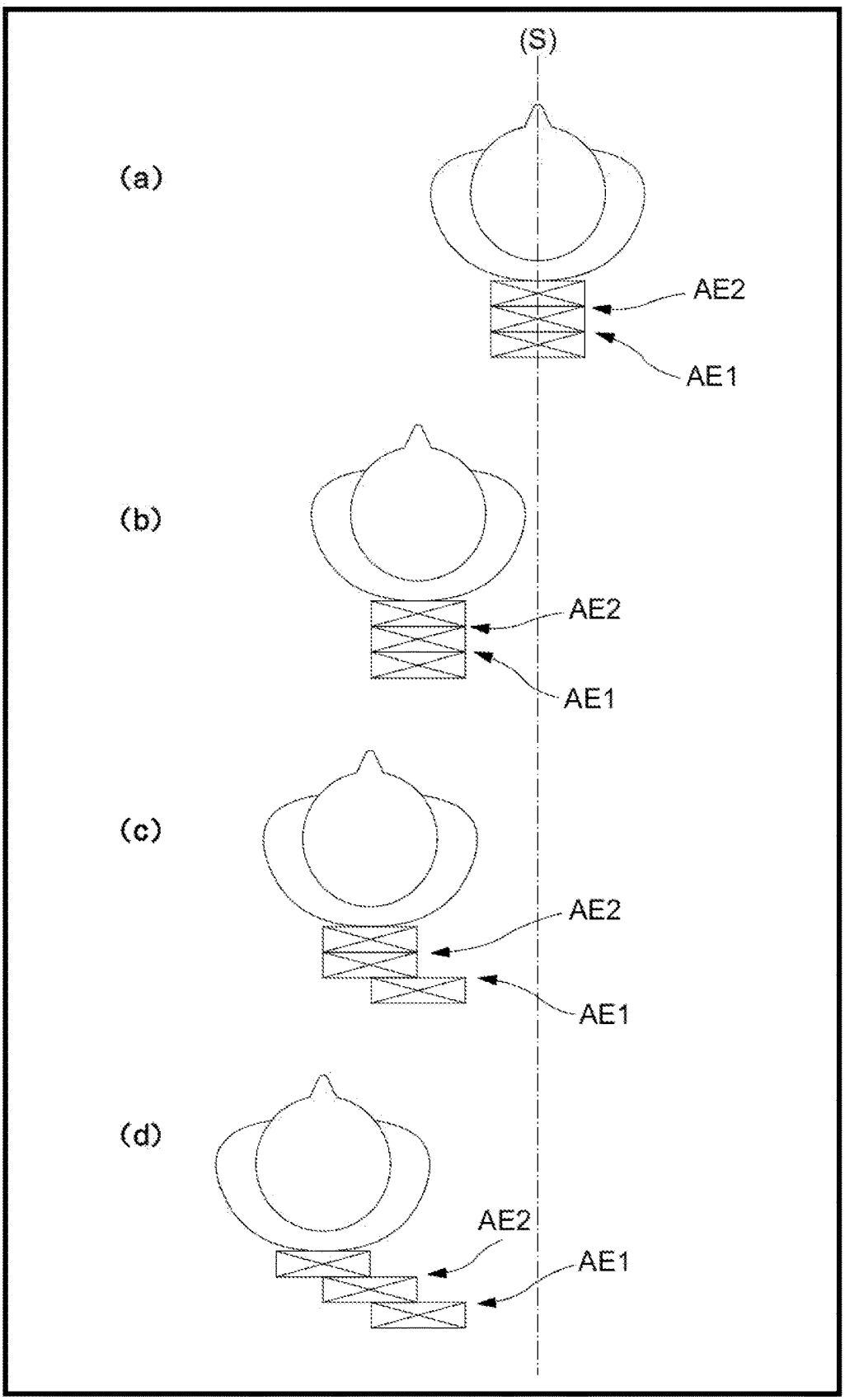
FIG. 23 is conceptual diagrams for escribing a function of amplifying a swinging movement in the present invention.
Figure 24:
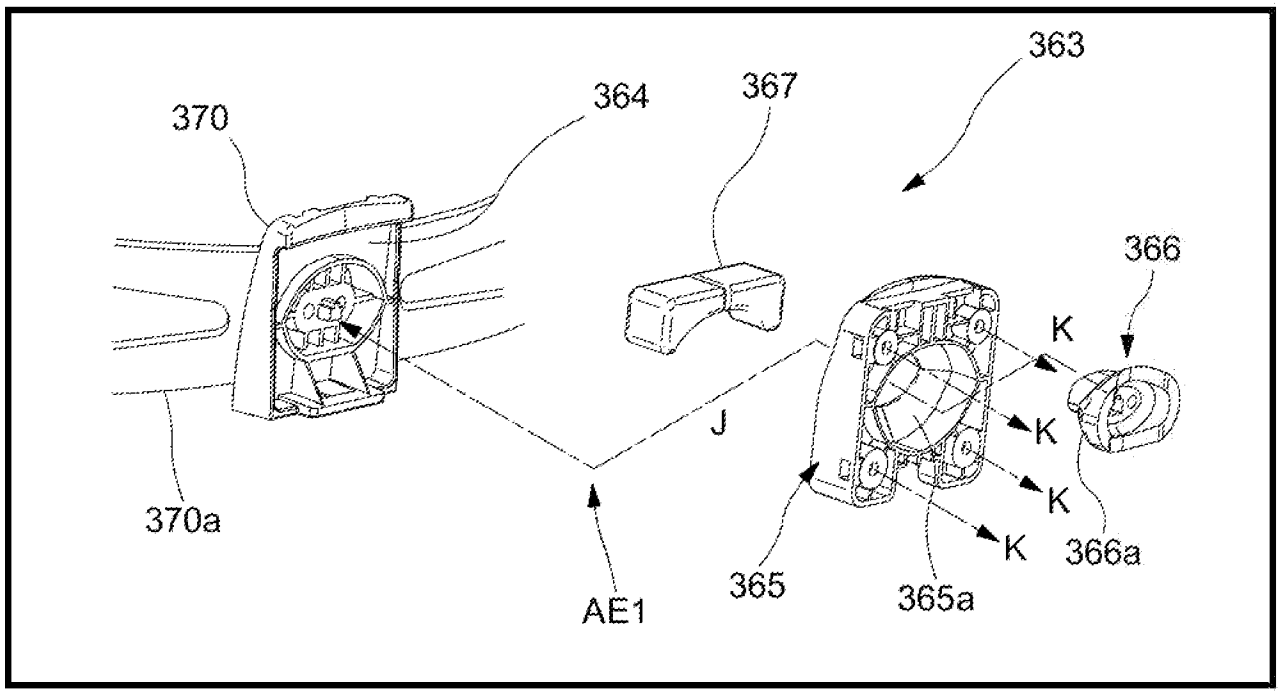
FIG. 24 is an exploded perspective view as seen from a back side of FIG. 22.

FIG. 23 is a conceptual diagram of the first amplification element AE1 and the second amplification element AE2. (a) in FIG. 23 illustrates a state where the seat and the backrest 306 are at the reference position (S) in the left-right direction. The backrest 306 moves from this state, for example, as illustrated in (b) in FIG. 23, to the left by the support mechanism SM. Next, the movement of the backrest 306 is amplified by the first amplification element AE1, as illustrated in (c) in FIG. 23, and further, the movement of the backrest 306 is further amplified by the second amplification element AE2. In the amplification elements AE1 and AE2, a mode for amplifying a movement in the same direction as the movement of the seat and the backrest, as illustrated in (c1) in FIG. 12, a mode for amplifying a movement along an arc as illustrated in (c2), a mode such as illustrated in (c3), in which a movement along the arc same as illustrated in (c2) is amplified, but in a direction different from that of (c2), and a mode for performing a negative amplification, that is, a movement in a direction where the amount of movement of the seat and the backrest is reduced, as illustrated in (c4), or another mode of movement may be appropriately combined and employed.

Among these modes of movement, in the present embodiment, an amplification operation is realized that combining a configuration similar to that in (c2) in two steps.

In the first amplification element, a universal operation unit 370 being a mechanically movable part having a structure slightly different from the mechanically movable part of the third embodiment, is provided in the backrest 306 via a universal bearing unit 363.

The universal bearing unit 363 includes a base unit 364 provided at a side of the backrest 306, a tilting unit 365 being arranged adjacent to the base unit 364, including a guide unit 365*a* recessed in a tapered shape toward the rear side, and having an open running in the front-rear direction at the center, and a pressing tool 366 including a guide unit 366*a* having a convex shape corresponding to the guide unit 365*a* at the front side, and being fixed to the base unit 364 via the opening of the tilting unit 365 in a state where the guide unit 366*a* is fitted into the guide unit 365*a*, as illustrated by an arrow J. A configuration is such that, as illustrated by arrows K, the tilting unit 365 is fixed to a back support unit 360*a* on an upper end side of a back frame 360 by tightening screws.

That is, the pressing tool 366 is fixed to the base unit 364 with the tilting unit 365 sandwiched therebetween, and thus, the pressing tool 366 is a part of the base unit 364 and is integrally formed with the base unit 364. The tilting unit 365 is movable freely relative to the base unit 364 and the pressing tool 366 in a gap between the base unit 364 and the pressing tool 366. In the tilting unit 365 moving freely, a configuration is such that an elastic body 367 interposed between the tilting unit 365 and the base unit 364 needs to be compressed against the elastic force. The elastic body 367 exerts a force on the guide unit 365*a* of the tilting unit 365 in a direction where the guide unit 365*a* is constantly fitted in the guide unit 366*a* of the pressing tool 366.

Figure 25:
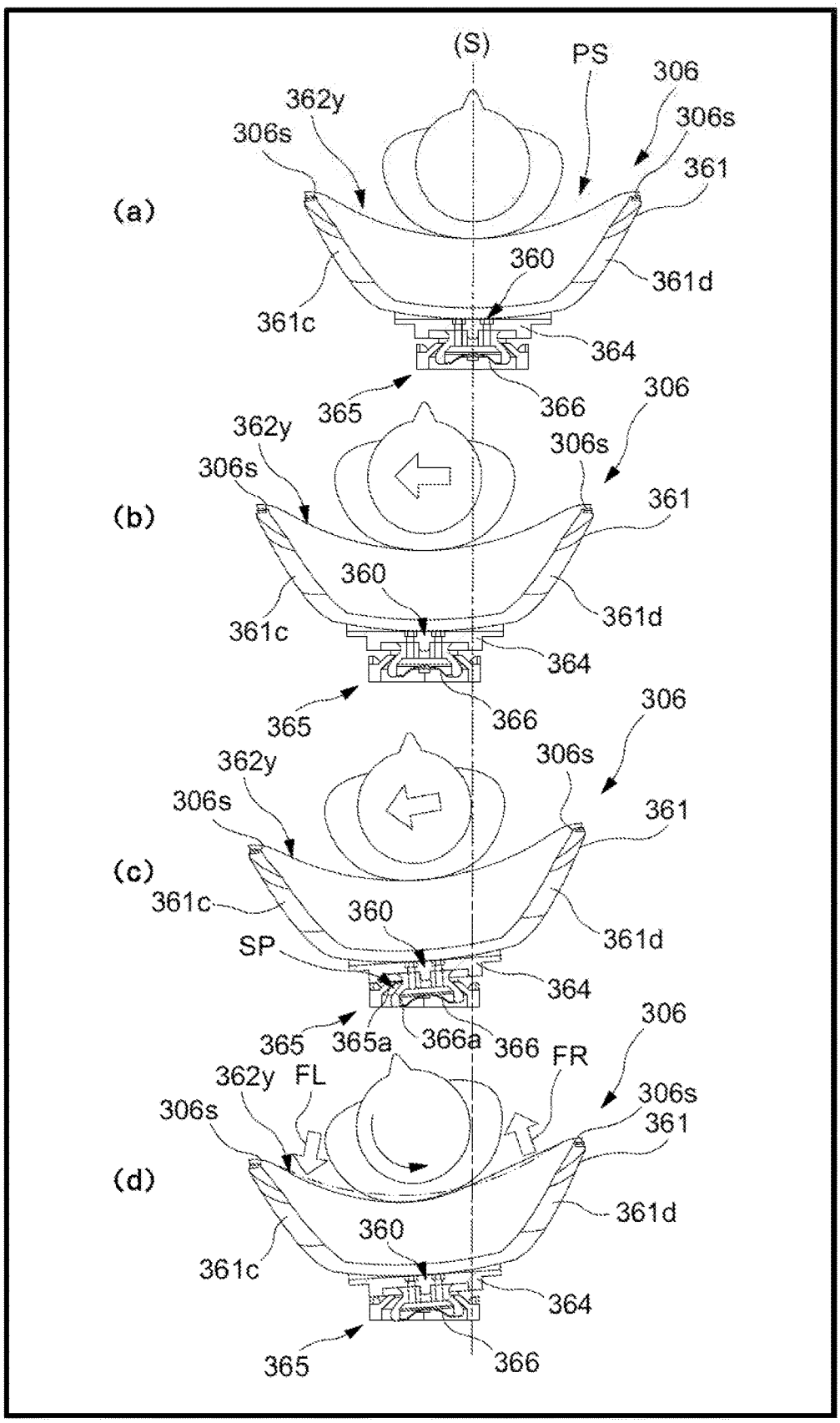
FIG. 25 is explanatory diagrams illustrating operations for describing the function of amplifying the swinging movement in the same embodiment.

The guide unit 365*a* of the tilting unit 365 included in the base unit 364 and the guide unit 366*a* of the pressing tool 366 are guided to and rest in a neutral position illustrated in (a) and (b) iii FIG. 25 because of the shape of the guide units 366*a* and 365*a* by pressure contact with the elastic body 367 included in the auxiliary return-force generation unit according to the present invention. In this case, the neutral position is a position where the guide units 366*a* and 365*a* closely contact each other. Subsequently, if the pressure contact is loosened when the elastic member 367 is compressed by a load being applied when receiving pressure from the seated person, the guide unit 365*a* of the tilting unit 365 and the guide unit 366*a* of the pressing tool 366 included in the base unit 364 are at least partly seceded from each other, as illustrated in (c) in FIG. 25, so that the backrest 306 moves freely. The base unit 364 and the tilting unit 365 relatively move relative to the neutral position in accordance with an amount of the received pressure and if the load is removed, an operating position is returned, along the guide units 366*a* and 365*a*, to the neutral position of (U) in FIG. 25. At this time, the backrest 306 is configured so that a gap SP between the guide units 366*a* and 365*a* widens in accordance with a movement in the rear direction with respect to the back frame 360, as illustrated in (c) in FIG. 25, and as a result, a turning range in the left-right direction expands and a return reaction force generated when the load is removed increases in accordance with the amount of turning movement in both the left and right directions.

In the present embodiment, the base unit 364 of the universal joint unit 363 is used as the universal operation unit 370, and a back frame 361 being a backrest main body unit is attached to the universal operation unit 370 via a left-right pair of arm units 370*a*.

The back frame 361 is a frame body similar to the frame body 61 being the backrest main body unit in the first embodiment, and the second amplification element is horizontal strap bodies 362*y* configured similarly to the horizontal strap bodies 62*y* in the first embodiment. A mesh fabric 362 which is an upholstery material having flexibility with low stretchability and in which the horizontal strap bodies 362*y* are also weaved together with vertical strap bodies 362*z* is also employed for the horizontal strap bodies 362*y*

The amplification effect by second strap bodies 362*y* is similar to that of the horizontal strap bodies 62*y* described with reference to FIG. 13 in the first embodiment.

That is, in the present embodiment, the first amplification element is the universal operation part 370 rotatably attached to the back frame 361 in the front-rear direction including the left-right direction, or the left-right direction, the second amplification element includes the flexibly deformable horizontal strap bodies 362*y* arranged along the left-right direction, and the pressure receiving surface PS includes at least an aggregated body of the horizontal strap bodies 362*y*.

Thus, as illustrated in FIG. 25, after being moved from the position in (a) to the position in (b) by the support mechanism SM, the backrest 306 is displaced from the position in (b) to the position in (c) by the universal operation unit 370 being the first amplification element, and is further displaced from the position in (c) to the position in (d) by the horizontal strap bodies 362*y* being the second amplification element. Also in this case, in some instances, the amplification effect of the universal operation unit 370 and the amplification effect of the horizontal strap bodies 362*y*, that is, the operation from (b) to (c) and the operation from (c) to (d) may be triggered simultaneously. As a repulsive force accumulates in the horizontal strap bodies 362*y* and the elastic body 367 which are the auxiliary return-force generation unit, the amplification effect is reduced.

A portion indicated by a broken line 306*s* in the drawings is an intermediate protrusion provided in the back frame 361. The intermediate protrusion 306*s* is configured to partially raise, toward the front, a portion other than ends of a left-right pair of side frame units 361*c* and 361*d* extending obliquely upward and downward to form the back frame 36. The intermediate protrusion 306*s* is also provided at a height position corresponding to a lumbar region of a seated person having an average physique, and this portion protrudes furthest to the front in a side view and this portion has also the widest width in the left-right direction in a front view.

Thus, if a two-step amplification function is provided, it is possible to allow for a swinging movement with a higher degree of amplification. The present embodiment is of course similar to the embodiments described above in that the horizontal strap bodies 362*y* being one of amplification elements perform an amplification operation independent from the movement operation of the back frame 361 being the main body unit or an amplification operation including a directional component different from the movement operation of the back frame 361, the horizontal strap bodies 362*y* partially perform an operation in a slowing direction, one of the amplification elements is the horizontal strap bodies 362*y*, the pressure receiving surface PS is formed by the mesh fabric 362 in which the horizontal strap bodies 362*y* are engaged with the vertical strap bodies 362*z*, the vertical strap bodies 362*z* and the horizontal strap bodies 362*y* are arranged in an opening of the back frame 361 being the main body unit, the mesh fabric 362 spanned between the intermediate protrusions 306*s* and 306*s* functions prominently as an amplification element, and the like, and thus, an operation and effect similar to those in the embodiments described above can be obtained.

In particular, the universal operation unit 370 is provided, and thus, it is possible to allow for a movement in a direction other than the left-right direction in the amplification operation.

Such a two-step amplification mechanism can be also applied to the seat. <Fifth Embodiment>

A fifth embodiment of the present invention will be described with reference to FIG. 23 and FIG. 26. Also in the present embodiment, the swinging operation of a backrest 406 in the left-right. direction is amplified in two steps by the first amplification element AE1 and a second amplification element AE2.

Basic configurations of the leg 1, the support base unit 2, and the support mechanism SM including the front-rear support unit 3 and the left-right support unit 4 are similar to those in the embodiments described above. Therefore, common portions are referred to by the same reference numerals and description thereof will be omitted.

The present embodiment is also based on the concept of FIG. 23, and in (a) in FIG. 23, the backrest 406 moves from a state where the seat and the backrest are at the reference position (S) in the left-right direction, for example, as illustrated in (b) in FIG. 23, to the left by the support mechanism SM illustrated in FIG. 3 and the like. Next, the movement of the backrest 406 is amplified by the first amplification element AE1, as illustrated in (c) in FIG. 23, and further, the movement of the backrest 406 is further amplified by the second amplification element AE2, as illustrated in (d) in FIG. 23. In the amplification elements AE1 and AE2, a mode for amplifying a movement in the same direction as the movement of the backrest 406, as illustrated in (c1) in FIG. 12, a mode for amplifying a movement along an arc as illustrated in (c2), a mode such as illustrated in (c3), in which a movement along the arc same as illustrated in (c2) is amplified, but in a direction different from that of (c2), and a mode for performing a negative amplification, that is, a movement in a direction where the amount of movement of the backrest 406 is reduced, as illustrated in (c4), or another mode of movement may be appropriately combined and employed.

Among these modes of movement, in the present embodiment, an amplification operation is realized that combining a configuration similar to that in (c2) in two steps.

Here, in the embodiments described above, the first amplification element is the universal operation unit 370 rotatably attached to the back frame being the main body unit in the front-rear direction including the left-right direction, or the left-right direction, and the second amplification element includes the flexibly deformable horizontal strap bodies 362*y* arranged along the left-right direction. However, in the present embodiment illustrated in FIG. 26, the first amplification element is a rotation unit 462 rotatably attached to a back frame 461 being the main body unit, around the shaft center Sz extending in a direction orthogonal to the left-right direction, the second amplification element includes flexibly deformable horizontal strap bodies 462*y* arranged along the left-right direction, and the pressure receiving surface PS includes at least an aggregated body of the horizontal strap bodies 462*y*. Similarly to the configuration illustrated in FIG. 22, a mesh fabric which is an upholstery material having flexibility with low stretchability and in which the horizontal strap bodies 462*y* are engaged with vertical strap bodies is employed for the horizontal strap bodies 462*y*.

The amplification function of the first amplification element is as described with reference to FIG. 20, and the amplification function of the second amplification element is as described with reference to FIG. 13.

Figure 26:
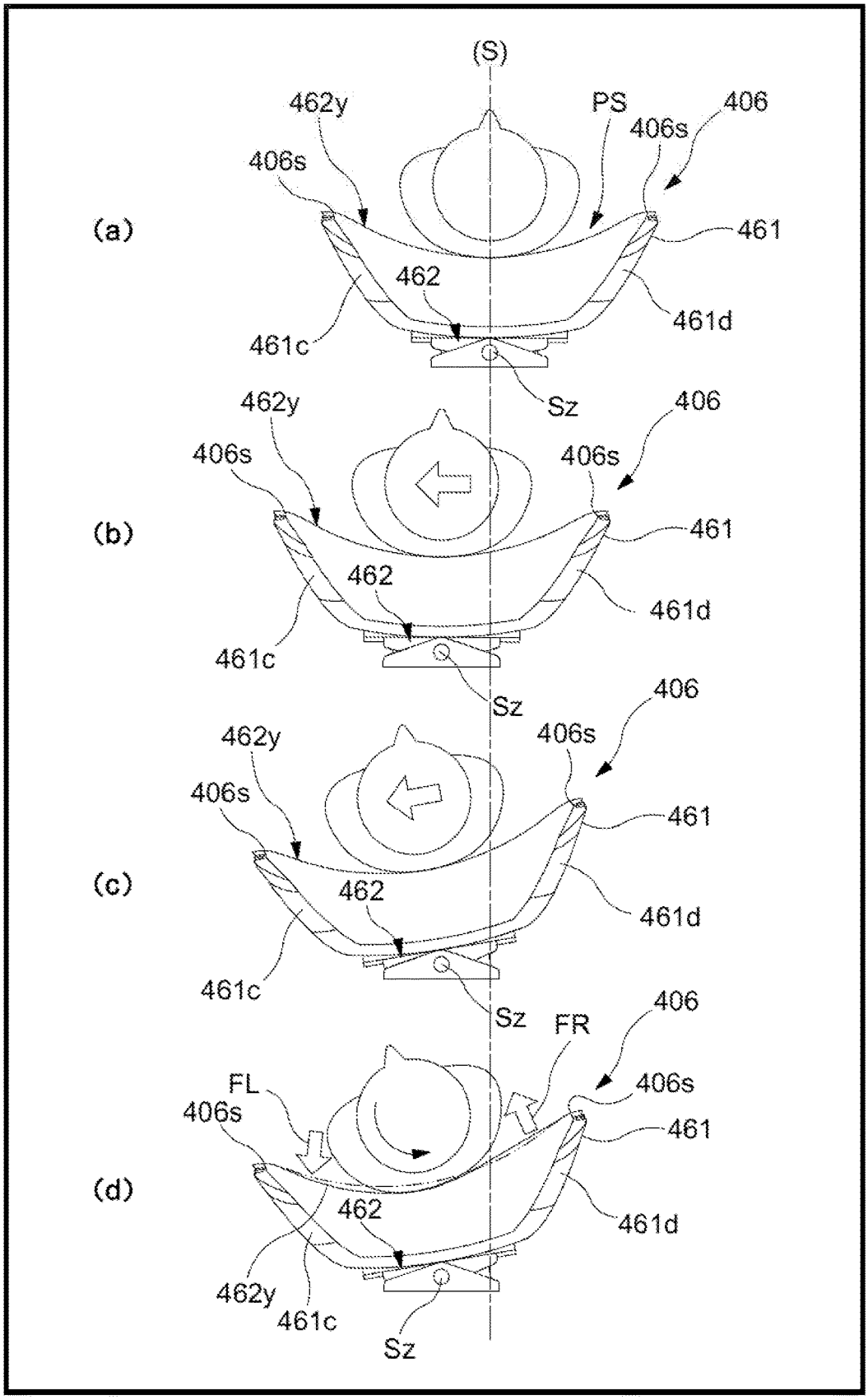
FIG. 26 is explanatory diagrams illustrating operations for describing a function of amplifying the swinging movement of a chair according to a fifth embodiment of the present invention.

With this configuration, as illustrated in FIG. 26, after being moved from the position in (a) to the position in (b) by the support mechanism SM, the backrest 406 is displaced from the position in (b) to the position in (c) by the rotation unit 462 being the first amplification element, and is further displaced from the position in (c) to the position in (d) by the horizontal strap bodies 462*y* being the second amplification element. Also in this case, in some instances, the amplification effect of the rotation unit 462 and the amplification effect of the horizontal strap bodies 462*y* may be triggered simultaneously. When a repulsive force accumulates in the horizontal strap bodies 462*y* and the elastic body 264 illustrated in FIG. 20 which are the auxiliary return-force generation unit, the amplification effect is reduced.

Figure 22:
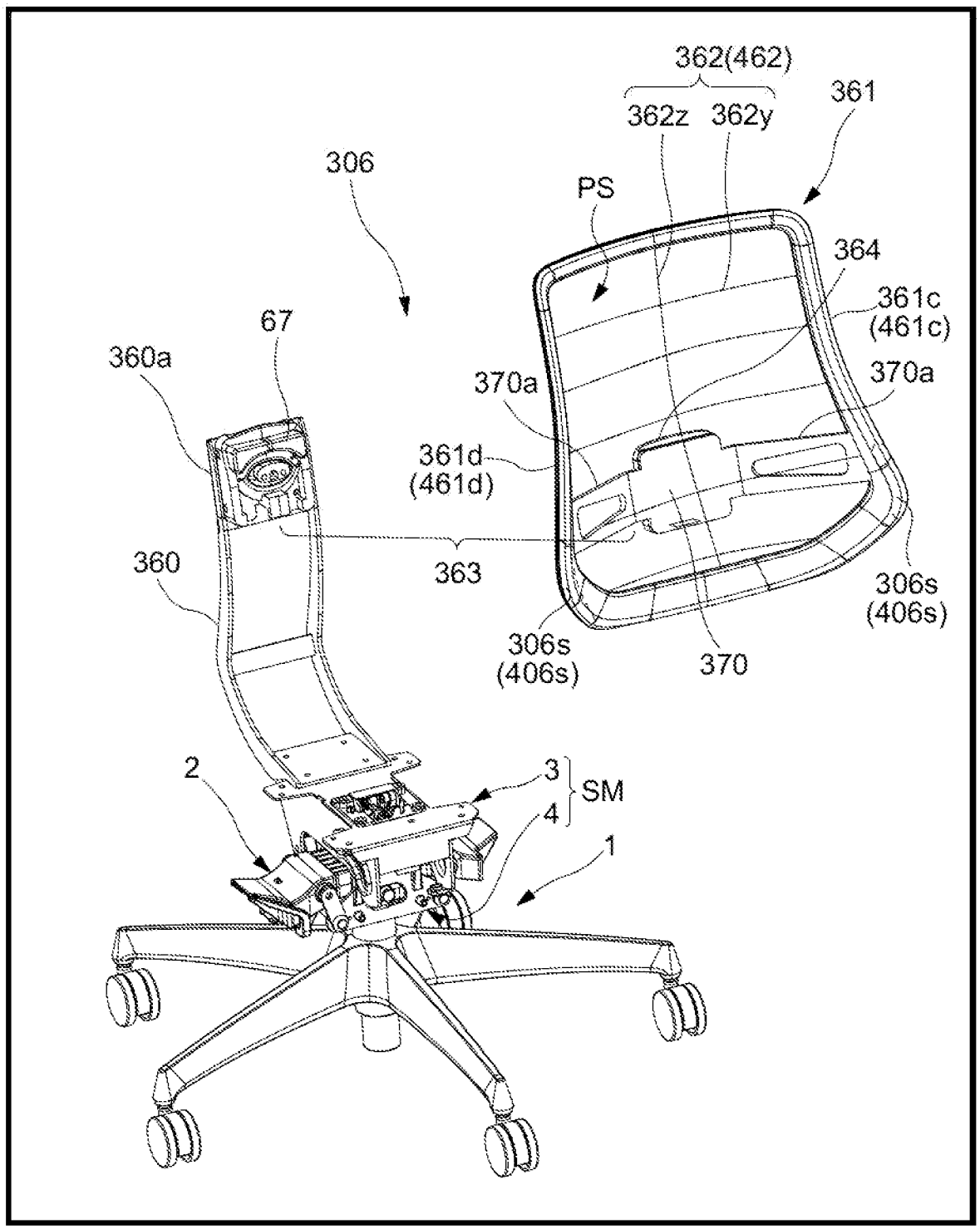
FIG. 22 is an exploded perspective view of a chair according to a fourth embodiment of the present invention.

FIG. 22 is used as a perspective view corresponding to the back frame illustrated in FIG. 26. Therefore, reference numerals of the portions corresponding to FIG. 26 is illustrated in parentheses in FIG. 22. A portion indicated by a broken line 406*s* in the drawings is an intermediate protrusion provided in the back frame 461. The intermediate protrusion 406*s* is configured to partially raise, toward the front, a portion other than ends of a left-right pair of side frame units 461*c* and 461*d* extending obliquely upward and downward to form the back frame 461. The intermediate protrusion 406*s* is also provided at a height position corresponding to a lumbar region of a seated person having an average physique, and this portion protrudes furthest to the front in a side view and this portion has also the widest width in the left-right direction in a front view.

Thus, if a two-step amplification function is provided, it is possible to allow for a swinging movement with a higher degree of amplification. The present embodiment is of course similar to the embodiments described above in that the horizontal strap bodies 462*y* being one of amplification elements perform an amplification operation independent from the movement operation of the back frame 461 being the main body unit or an amplification operation including a directional component different from the movement operation of the back frame 461, the horizontal strap bodies 462*y* partially perform an operation in a slowing direction, one of the amplification elements is the horizontal strap bodies 462*y*, the horizontal strap bodies 462*y* are engaged with vertical strap bodies to form a pressure receiving surface, a mesh fabric 462 spanned between the intermediate protrusions 406*s* and 406*s* functions prominently as an amplification element, and the like, and thus, an operation and effect similar to those in the embodiments described above can be obtained.

Such a two-step amplification mechanism can be similarly applied to the seat.

Thus, an embodiment of the present invention has been described, and a specific configuration of each unit is not limited to that in the embodiments described above and various modifications are possible without departing from the gist of the present invention.

Figure 27A:
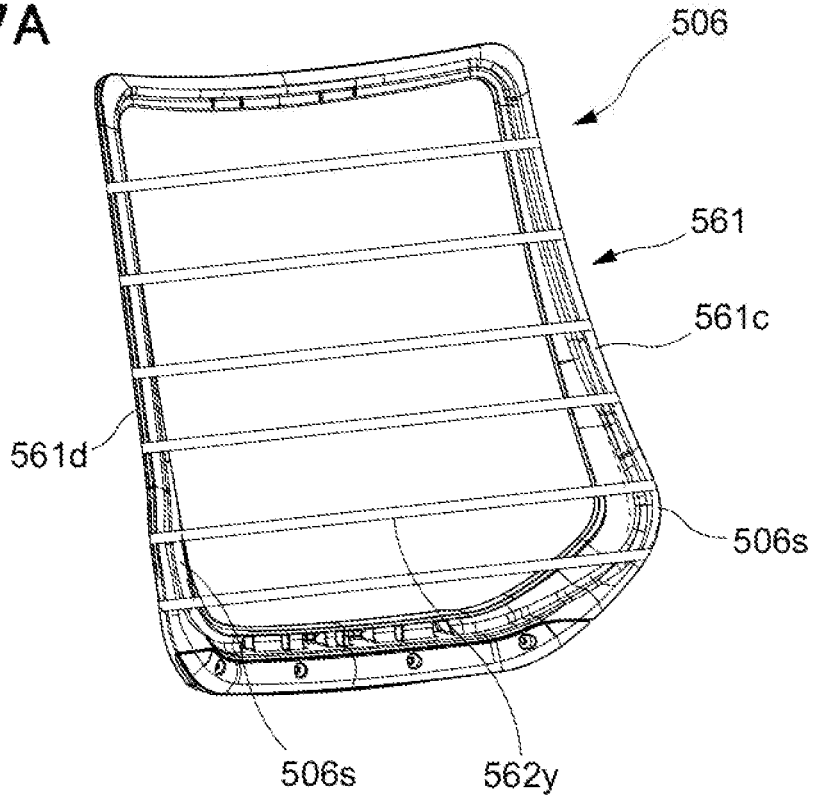
FIGS. 27A and 27B are diagrams illustrating modifications of the present invention.
Figure 27B:
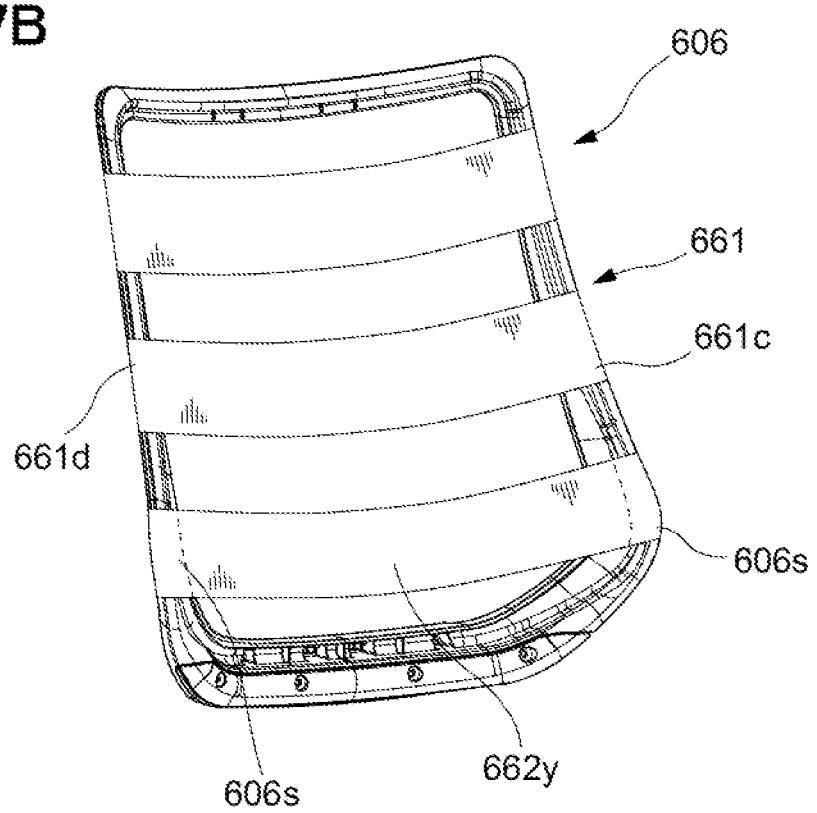

For example, in an example in which the amplification element includes an upholstery material having flexibility with low stretchability as illustrated in FIG. 27A, a wire 562*y* spanned between left and right side frame units 561*c* and 561*d* of a back frame 561 included in a backrest 506, or alternatively, as illustrated in FIG. 27B, a. belt 662*y* spanned. between left and right side frame units 661*c* and 661*d* of a back frame 661 included in a backrest 606 may be employed.

It is effective to configure the amplification element by providing an intermediate protrusion 506*s* (606*s*) protruding furthermost toward the seated person at a position other than both ends of the side frame units 561*c* and 561*d* (661*c* and 661*d*) in the extending direction of the side frame units 561*c* and 561*d* (661*c* and 661*d*) and previously spanning the wire 562*y* or the belt 662*y* being the amplification element at least between the intermediate protrusions 506*s* and 506*s* (between the intermediate protrusions 606*s* and 606*s*) of the left and right side frame units 561*c* and 561*d* (661*c* and 661*d*). Thus, even in these configurations, an operation and effect similar to those in the above-described embodiments in which a mesh material is employed as the upholstery material can be obtained. That is, the wire 562*y* or the belt 662*y* spanned between the intermediate protrusions 506*s* and 506*s* (between the intermediate protrusions 606*s* and 606*s*) preferentially abuts against the seated person, so that a load of the seated person is easily received locally and the deformation from the received load increases the tension around the seated person, and thus, an effect of amplifying a movement in the left-right direction is intensified. Therefore, the seated person can perceive a feeling of being inclined more than the inclination of the backrest 506. The intermediate protrusion 506*s* (606*s*) serves as a side support supporting the inclined body of the seated person from the side via the wire 562*y* or the belt 662*y*, and thus, it is possible to effectively prevent the seated person from losing balance.

The same applies to the seat and even if a wire or a. belt being au upholstery material having flexibility with low stretchability is spanned as an amplification element between intermediate protrusions of left and right side frame units of the seat, an effect similar to the one in FIGS. 27A and 27B can be obtained.

Further, the positions of the left-right support unit and the front-rear support unit included in the support mechanism may be inversed in the up-down direction.

Further, the support mechanism may include a guide hole and a follower in both the front support unit and the rear support unit.

Alternatively, the support mechanism may include a guide hole and a follower in both the left support unit and the right support unit.

Further, the support mechanism may include a link in both the front support unit and the rear support unit.

Further, the support mechanism may support an element to be freely movable in the front-rear or the left-right direction by three hanging links.

Various other changes may be applied to other configurations without departing from the gist of the present invention.

INDUSTRIAL APPLICABILITY

According to the configuration described above, the present invention can be suitably applied to an office revolving chair and the like.

REFERENCE SIGNS LIST

1 . . . Leg
6 . . . Backrest
6*s* . . . Intermediate protrusion (side support)
61 . . . Main body unit (back frame)
62*y* Amplification element (horizontal strap body)
62*z* Vertical strap body
105*s* . . . Intermediate protrusion (side support)
151 . . . Seat frame
152*y* . . . Amplification element (horizontal strap body)
205 . . . Seat
252 . . . Amplification element (rotation unit)
253 . . . Bearing unit
262 . . . Amplification element (rotation unit)
263 . . . Bearing unit
306*s* . . . Intermediate protrusion (side support)
362*y* . . . horizontal strap body
363 . . . Universal joint unit
370 . . . Amplification element (universal operation unit)
406 . . . Backrest
406*s* . . . Intermediate protrusion (side support)
462 . . . Amplification element (rotation unit)
506 . . . Backrest
506*s* . . . Intermediate protrusion (side support)
606 . . . Backrest
606*s* . . . Intermediate protrusion (side support)
AE1 . . . First amplification element
AE2 . . . Second amplification element
PS . . . Pressure receiving surface
S . . . Reference position
SM . . . Support mechanism

The invention claimed is:

1. A chair comprising:

a leg erected on a floor surface;

a seat arranged above the leg;

a backrest being arranged behind the leg and including a pressure receiving surface; and a support mechanism arranged below the seat to be interposed between the leg and the seat and configured to movably support the seat in a front-rear or left-right direction along a predetermined trajectory and to downwardly incline a tip side of the seat in a movement direction in accordance with a movement of the seat from a predetermined reference position, wherein the support mechanism including a return-force generation unit configured to generate, in accordance with an amount of movement, a return force in a direction in which the seat moved from the reference position in the front-rear or left-right direction is returned to the reference position, and being configured to movably support the backrest in the left-right direction together with a movement of the seat in the left-right direction, wherein at least one of the seat or the backrest includes a main body unit, and an amplification element attached to the main body unit and configured to further amplify a movement operation of the main body unit in the left-right direction among movement operations of the main body unit, wherein the amplification element is configured to perform an amplification operation independent from a movement operation of the main body unit in the left-right direction, wherein the amplification element includes flexibly deformable horizontal strap bodies arranged along the left-right direction.

2. The chair according to claim 1, wherein the amplification element is configured to perform an amplification operation including a directional component other than a movement operation of the main body unit in the left-right direction.

3. The chair according to claim 2, wherein the movement operation of the main body unit in the left-right direction is a swinging operation in the left-right direction in a front view, and the amplification element is configured to perform an amplification operation including a turning operation in the left-right direction in a plan view.

4. The chair according to claim 1, wherein the amplification element is configured to perform either an amplification operation in a positive direction for increasing the movement operation in the left-right direction or an amplification operation in a negative direction for reducing the movement operation.

5. The chair according to claim 1, wherein the amplification element is configured to perform both an amplification operation in a positive direction for increasing the movement operation in the left-right direction and an amplification operation in a negative direction for reducing the movement operation.

6. The chair according to claim 1, wherein the amplification element is a mechanically movable unit attached via a bearing unit.

7. The chair according to claim 1, wherein the amplification element is a rotation unit attached to the main body unit to be rotatable around a shaft center extending in a direction orthogonal to the left-right direction.

8. The chair according to claim 1, wherein the horizontal strap bodies are engaged with a plurality of flexibly deformable vertical strap bodies arranged along the vertical strap body arranged at a center portion in the left-right direction and a position displaced from the center portion in the left-right direction.

9. The chair according to claim 1, wherein a vertical strap bodies and the horizontal strap bodies are arranged in an opening of a frame body included in the main body unit.

10. The chair according to claim 9, wherein a side support protruding toward a seated person is provided in left and right side units of the frame body.

11. A chair comprising:

a leg erected on a floor surface;

a seat arranged above the leg;

a backrest being arranged behind the leg and including a pressure receiving surface; and a support mechanism arranged below the seat to be interposed between the leg and the seat and configured to movably support the seat in a front-rear or left-right direction along a predetermined trajectory and to downwardly incline a tip side of the seat in a movement direction in accordance with a movement of the seat from a predetermined reference position, wherein the support mechanism including a return-force generation unit configured to generate, in accordance with an amount of movement, a return force in a direction in which the seat moved from the reference position in the front-rear or left-right direction is returned to the reference position, and being configured to movably support the backrest in the left-right direction together with a movement of the seat in the left-right direction, wherein at least one of the seat or the backrest includes a main body unit, and an amplification element attached to the main body unit and configured to further amplify a movement operation of the main body unit in the left-right direction among movement operations of the main body unit, wherein the amplification element is configured to perform an amplification operation independent from a movement operation of the main body unit in the left-right direction, wherein the main body unit includes a frame body having a left-right pair of extending side frame units, the side frame units include intermediate protrusions protruding furthermost toward a seated person at a position other than both ends of the side frame units in an extending direction of the side frame units, and an upholstery material having flexibility is spanned at least between the intermediate protrusions of the left and right side frame units to form the amplification element.

12. A chair comprising:

a leg erected on a floor surface;

a seat arranged above the leg;

a backrest being arranged behind the leg and including a pressure receiving surface; and a support mechanism arranged below the seat to be interposed between the leg and the seat and configured to movably support the seat in a front-rear or left-right direction along a predetermined trajectory and to downwardly incline a tip side of the seat in a movement direction in accordance with a movement of the seat from a predetermined reference position, wherein the support mechanism including a return-force generation unit configured to generate, in accordance with an amount of movement, a return force in a direction in which the seat moved from the reference position in the front-rear or left-right direction is returned to the reference position, and being configured to movably support the backrest in the left-right direction together with a movement of the seat in the left-right direction, wherein at least one of the seat or the backrest includes a main body unit, and an amplification element attached to the main body unit and configured to further amplify a movement operation of the main body unit in the left-right direction among movement operations of the main body unit, wherein the amplification element is configured to perform an amplification operation independent from a movement operation of the main body unit in the left-right direction, wherein the amplification element includes a first amplification element configured to amplify a movement operation of the main body unit in the left-right direction, and a second amplification element configured to further amplify an operation of the first amplification element.

13. The chair according to claim 12, wherein the first amplification element is a rotation unit attached to the main body unit to be rotatable around a shaft center extending in a direction orthogonal to the left-right direction, and the second amplification element includes flexibly deformable horizontal strap bodies arranged along the left-right direction.

14. The chair according to claim 12, wherein the first amplification element is a universal operation unit attached to the main body unit to be rotatable in the front-rear direction, or the left-right direction, and the second amplification element includes flexibly deformable horizontal strap bodies arranged along the left-right direction.

15. The chair according to claim 1, wherein the amplification element includes an auxiliary return-force generation unit configured to return, if a pressure applied to the pressure receiving surface is removed, from an amplification destination to a neutral position being a position at a time when no pressure is received.

* * * * *